US008910548B2

(12) United States Patent
Borwig

(10) Patent No.: US 8,910,548 B2
(45) Date of Patent: Dec. 16, 2014

(54) DUCT WRAP DISPENSER

(75) Inventor: Michael C. Borwig, Swisher, IA (US)

(73) Assignee: Mestek Machinery, Inc., Westfield, MA (US)

( * ) Notice: Subject to any disclaimer, the term of this patent is extended or adjusted under 35 U.S.C. 154(b) by 290 days.

(21) Appl. No.: 13/598,103

(22) Filed: Aug. 29, 2012

(65) Prior Publication Data

US 2013/0047556 A1 Feb. 28, 2013

Related U.S. Application Data

(60) Provisional application No. 61/528,344, filed on Aug. 29, 2011, provisional application No. 61/577,710, filed on Dec. 20, 2011.

(51) Int. Cl.

| | |
|---|---|
| ***B26D 1/00*** | (2006.01) |
| ***B26D 7/06*** | (2006.01) |
| ***B26D 5/12*** | (2006.01) |

(52) U.S. Cl.

USPC ..... 83/13; 83/100; 83/613; 225/22; 225/89

(58) Field of Classification Search

USPC ..... 83/13, 100, 613, 42, 175, 614, 282; 53/203, 370.5, 461, 370.3; 225/22, 89

See application file for complete search history.

(56) References Cited

U.S. PATENT DOCUMENTS

| | | | | |
|---|---|---|---|---|
| 3,001,352 | A | 9/1961 | Harrison | |
| 3,738,210 | A * | 6/1973 | Fujio | 83/175 |
| 3,939,622 | A * | 2/1976 | Murphy et al. | 53/432 |
| 4,152,879 | A * | 5/1979 | Shulman | 53/399 |
| 4,619,103 | A * | 10/1986 | Kenrick | 53/432 |
| 4,912,911 | A | 4/1990 | Down | |
| 4,984,413 | A | 1/1991 | Cosmo | |
| 5,020,300 | A * | 6/1991 | Casteel | 53/399 |
| 5,450,711 | A * | 9/1995 | Martin-Cocher | 53/556 |
| 5,606,849 | A * | 3/1997 | Bettenhausen | 53/556 |
| 5,819,503 | A * | 10/1998 | Lancaster, III | 53/399 |
| 5,878,555 | A * | 3/1999 | Turfan et al. | 53/588 |
| 5,944,244 | A * | 8/1999 | Lisec | 225/96.5 |
| 6,079,187 | A * | 6/2000 | Velderman et al. | 53/436 |
| 6,755,105 | B2 * | 6/2004 | Downing | 83/175 |
| 6,854,247 | B2 | 2/2005 | Lancaster, III et al. | |
| 6,895,732 | B2 * | 5/2005 | Sperry et al. | 53/562 |
| 7,089,716 | B2 * | 8/2006 | Sterling | 53/438 |

OTHER PUBLICATIONS

International Search Report dated Nov. 20, 2012 from corresponding PCT Application No. PCT/US2012/052855.

* cited by examiner

*Primary Examiner* — Sean Michalski

(74) *Attorney, Agent, or Firm* — McCormick, Paulding & Huber LLP

(57) ABSTRACT

A finishing apparatus for ductwork having a duct body with at least one open end. The finishing apparatus includes an operation platform for selectively supporting the ductwork and a first wrapping mechanism integrated with the operation platform, the first wrapping mechanism including a first dispenser for dispensing a first film. The finishing apparatus further includes a first cutting mechanism integrated with the first wrapping mechanism. In operation, the first wrapping mechanism selectively dispenses the first film adjacent to and against the open end of the ductwork as the ductwork is moved a predetermined distance down the operation platform. The first cutting mechanism selectively cutting the first film after the ductwork has moved the predetermined distance down the operation platform.

14 Claims, 27 Drawing Sheets

DUCT WRAP DISPENSER

CROSS REFERENCE TO RELATED APPLICATION

This application claims the benefit of U.S. Provisional Application Ser. No. 61/528,344, filed on Aug. 29, 2011, which is hereby incorporated by reference in its entirety.

FIELD OF THE INVENTION

The present invention relates to ventilation equipment and, more particularly, to packaging and storage of ventilation duct sections.

BACKGROUND OF THE INVENTION

Ventilation ducts are manufactured as open-ended sections or segments of sheet metal tubing in profiles of various shapes. Typically the ends of the duct sections have flanges. The duct sections frequently are stored in warehouses before being shipped to a final install destination. During warehouse storage, and in transit on open trucks or railcars, it is possible for debris or pests to enter the open ends of the duct sections.

To prevent entry of debris or pests, the open ends of duct sections can be covered. Cling wrap or similar film ("duct wrap") is often used for this purpose. Manual application of duct wrap is labor intensive and also is surprisingly hard to accomplish without tearing or gapping the duct wrap in a manner that would render the whole exercise pointless.

Accordingly, it is desirable to have a machine or apparatus that will provide for easier attachment of duct wrap onto manufactured ventilation ducts.

SUMMARY OF THE INVENTION

According to the present invention, a duct wrap dispenser is provided for attaching duct wrap onto the open ends of a ventilation duct section. The duct wrap dispenser includes a roller conveyer for supporting each duct section in a vertical posture, and also includes a frame surrounding and extending above the roller conveyor. The roller conveyor supports a lower wrapping tool that includes two pivotal roller assemblies, vacuum tubes, and a lower cut-off knife. The frame supports an upper wrapping tool that includes an upper wrap supply, vacuum tubes, an upper applicator, and an upper cut-off knife. The vacuum tubes hold the duct wrap in position to receive and contact each duct section as it moves along the roller conveyor. The applicators press the duct wrap against the open ends of the duct section, ensuring adhesion of the duct wrap to the duct section. The cut-off knives sever the duct wrap after the duct section has moved through the wrapping tools and has been fully wrapped.

These and other objects, features and advantages of the present invention will become apparent in light of the detailed description of the best mode embodiment thereof, as illustrated in the accompanying drawings.

DETAILED DESCRIPTION OF EMBODIMENTS

Figure 1:
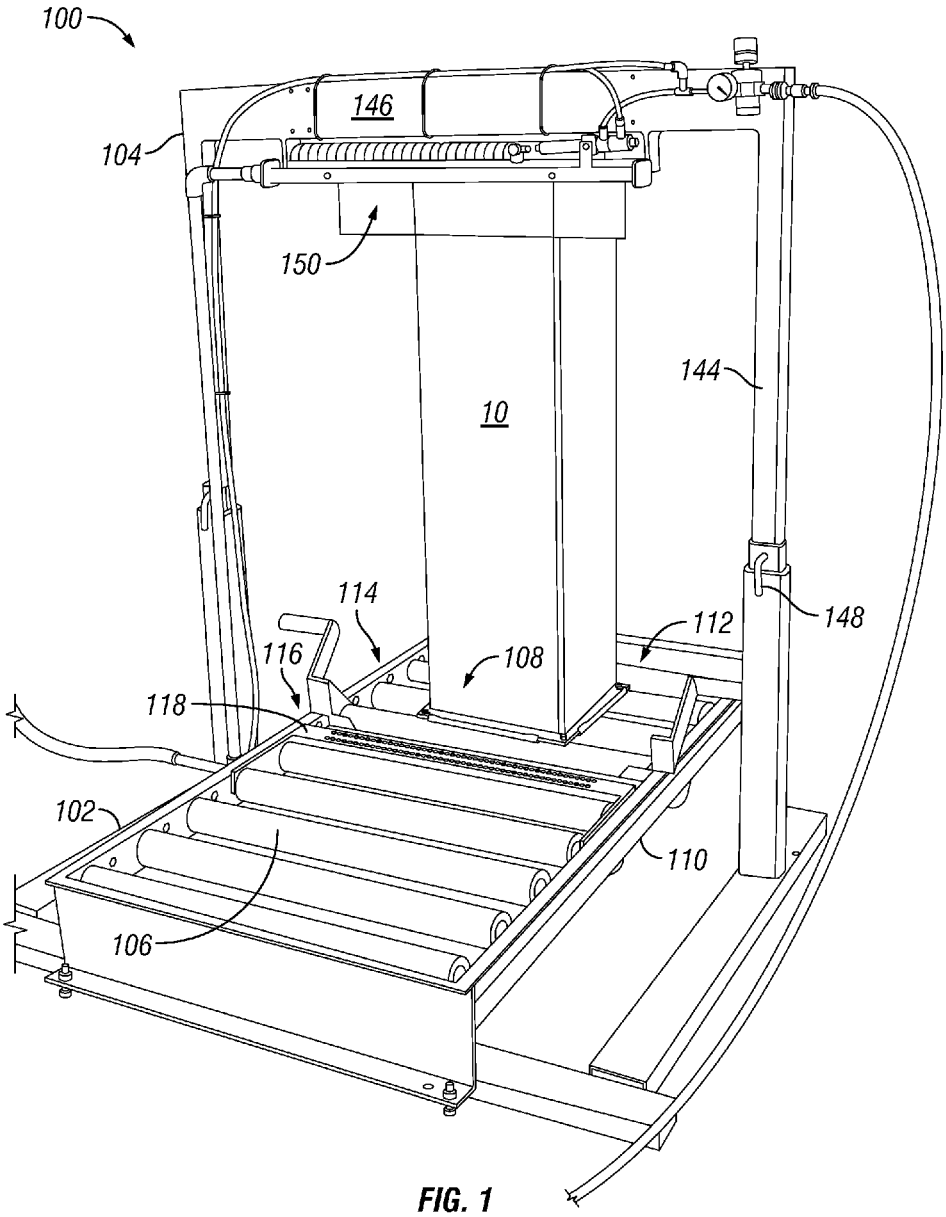
FIG. 1 shows in perspective the exit side of a duct wrap dispenser including a conveyor housing a lower wrapping tool and a standing frame supporting an upper wrapping tool, according to an embodiment of the present invention.

FIG. 1 shows a duct wrap dispenser 100, according to one embodiment of the present invention. The duct wrap dispenser includes a roller conveyor 102 and a standing frame 104 mounted to the roller conveyer, and is shown from the exit end of the roller conveyor. A small duct section or segment 10 is shown at the entry end of the duct wrap dispenser, ready to move through the dispenser.

In the disclosed embodiments of the invention, the rollers 106 of the conveyor 102 are non-powered, and the duct section 10 is pushed by an operator along the conveyor. Alternatively, powered rollers could be used. By incorporating a programmable logic controller (PLC) and position sensors such as photo eyes or finger switches, a completely automated embodiment of the invention could be provided, as will be apparent to those of ordinary skill after reviewing the following detailed description.

The roller conveyor 102 includes a plurality of rollers 106 mounted on fixed axles, as well as a lower wrapping tool 108 mounted between the conveyor frame rails 110 at a middle region of the conveyor. Proceeding from the entry end of the dispenser 100, the lower wrapping tool 108 includes a swing-up hinged sub frame 112, then a pivot assembly 114, and finally a slicing apparatus 116 that includes two or more vacuum tubes 118, with a cut-off knife housed between the first and second vacuum tubes.

Figure 2:
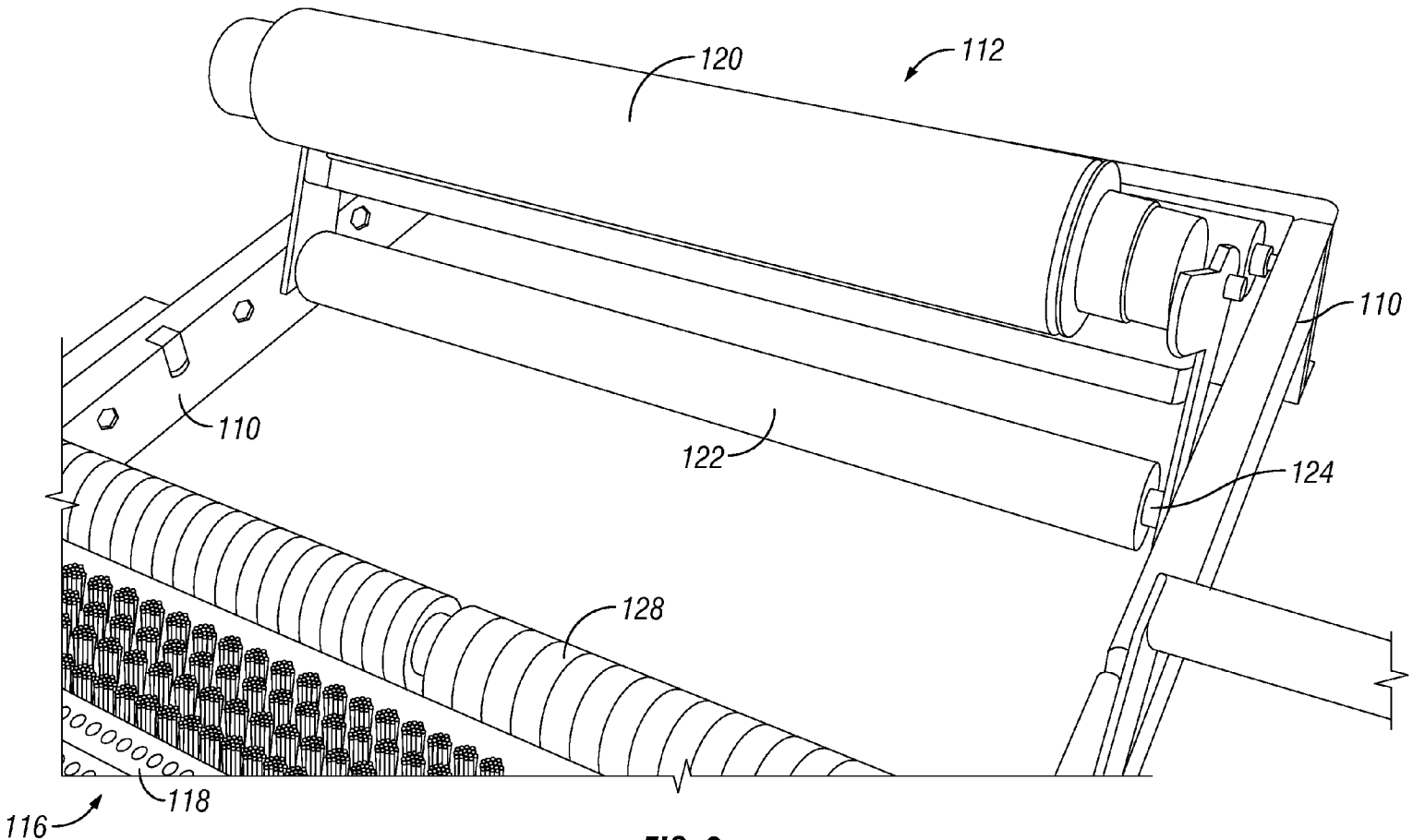
FIG. 2 shows a hinged sub frame portion of the conveyor shown in FIG. 1, swung up to render a slid-in core support accessible for loading a roll of duct wrap film.

Referring to FIG. 2, the hinged sub-frame 112 includes a duct wrap supply 120 for the lower wrapping tool 108, and a roller 122 that is normally disposed above the duct wrap supply. In case the lower wrapping tool runs out of duct wrap, the hinged sub-frame is mounted to the conveyor frame rails 110 on spring centered hex axles 124. These axles permit the hinged sub-frame to swing up from the conveyor rails to an extended position where the lower wrap supply is accessible for reloading with a full roll of duct wrap film. The lower wrap supply is shown to include a slide-in support rod 126 for the roll of duct wrap, however, other supports are within the scope of the invention as further discussed with reference to FIG. 23.

Figure 3:
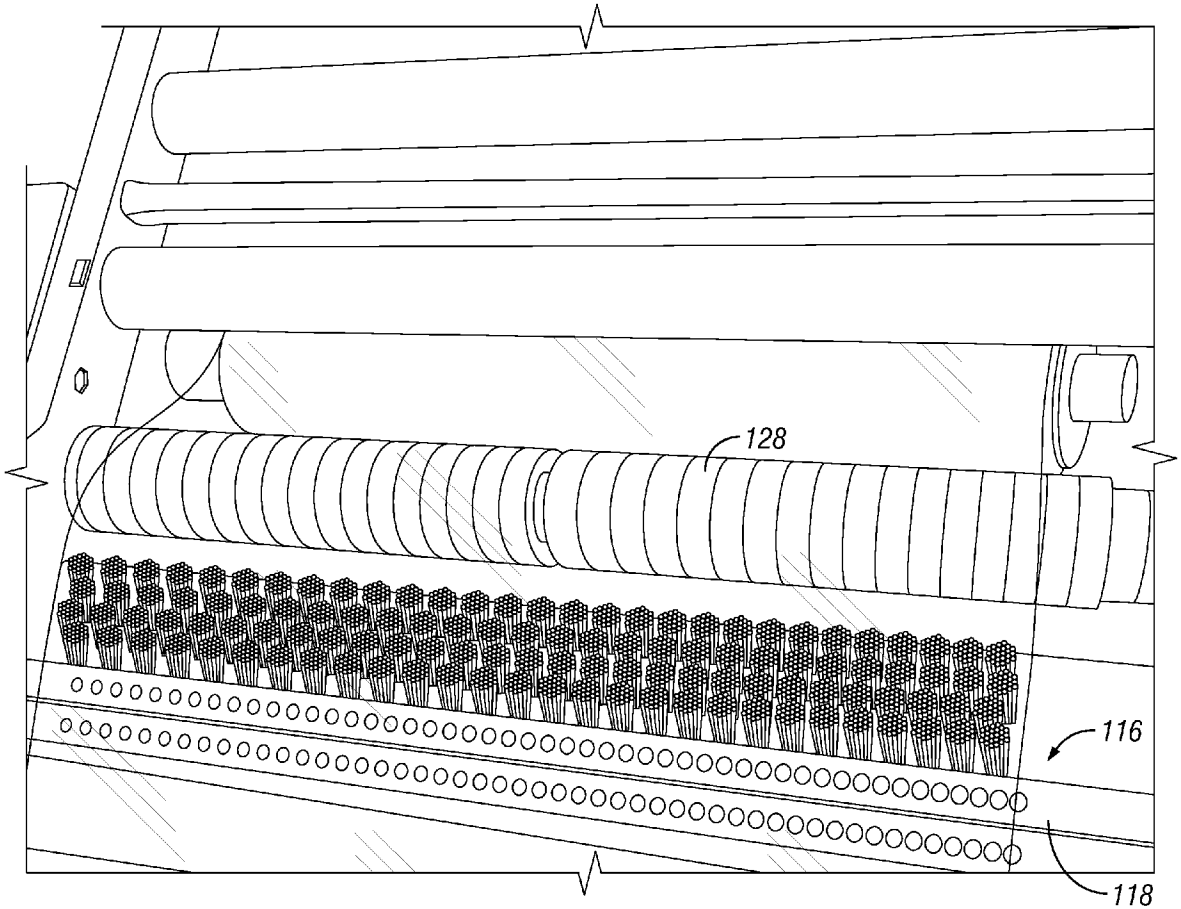
FIG. 3 shows the swing-up sub-frame in its normal retracted position, ready for use with the duct wrap film routed across the lower wrapping tool.

When the duct wrap film is loaded onto the lower wrap supply 120 in the hinged sub-frame 112, it is pulled across the pivot assembly 114 and the slicing apparatus 116 toward the exit end of the conveyor, as shown in FIG. 3. Generally, the rollers 106 have polished metal surfaces to which the duct wrap does not adhere. However, in the pivot assembly one roller 128 is coated with rubber or equivalent material that will adhere to the duct wrap. The duct wrap contacts this rubber covered roller, which helps to hold the duct wrap in position after it is sliced as further discussed below.

Figure 4:
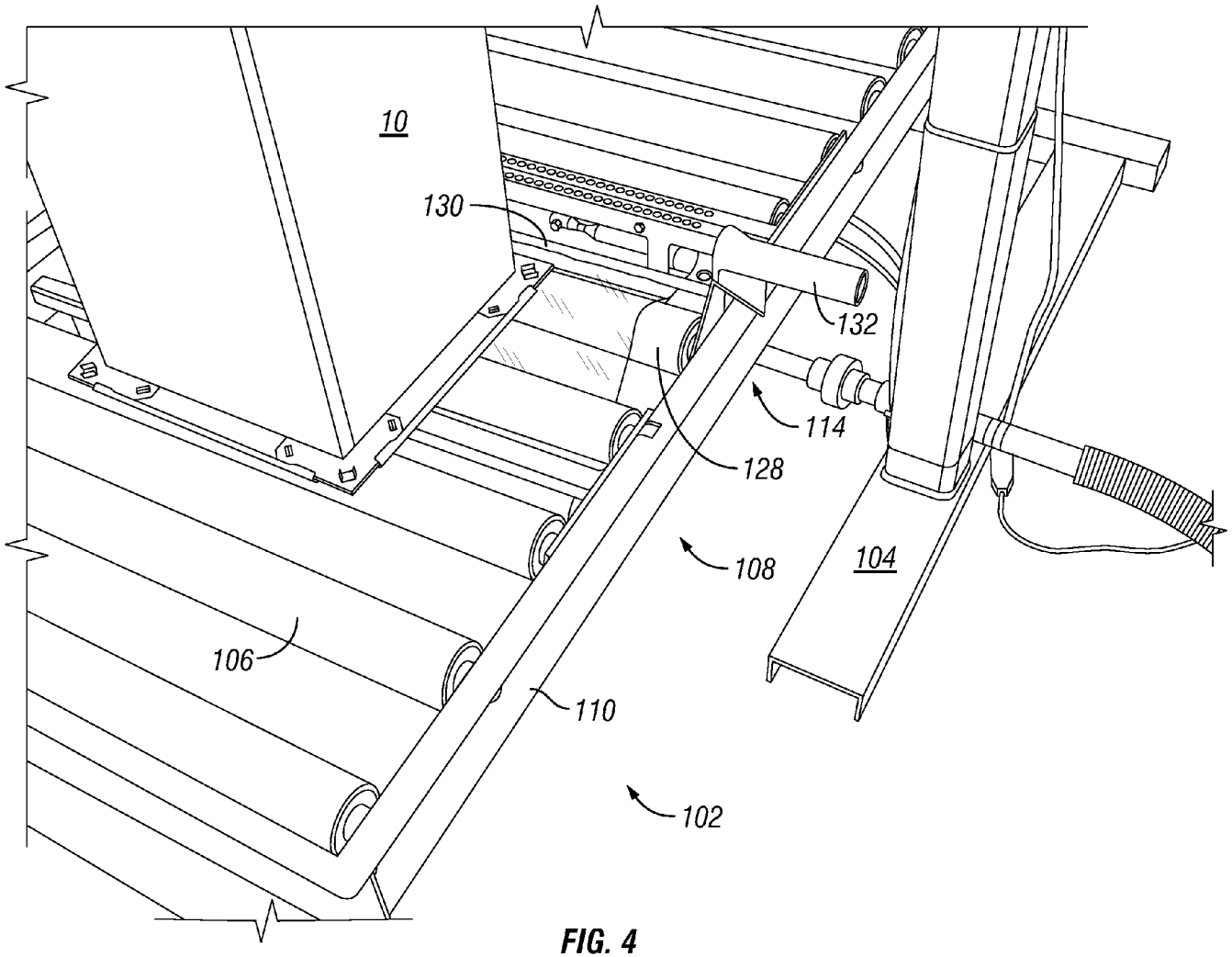
FIGS. 4 through 6 show the lower wrapping tool including a pivot assembly with foot operated levers for moving a sponge applicator from a recessed position to a deployed position for adhering the duct wrap film to the leading side of a duct section.
Figure 5:
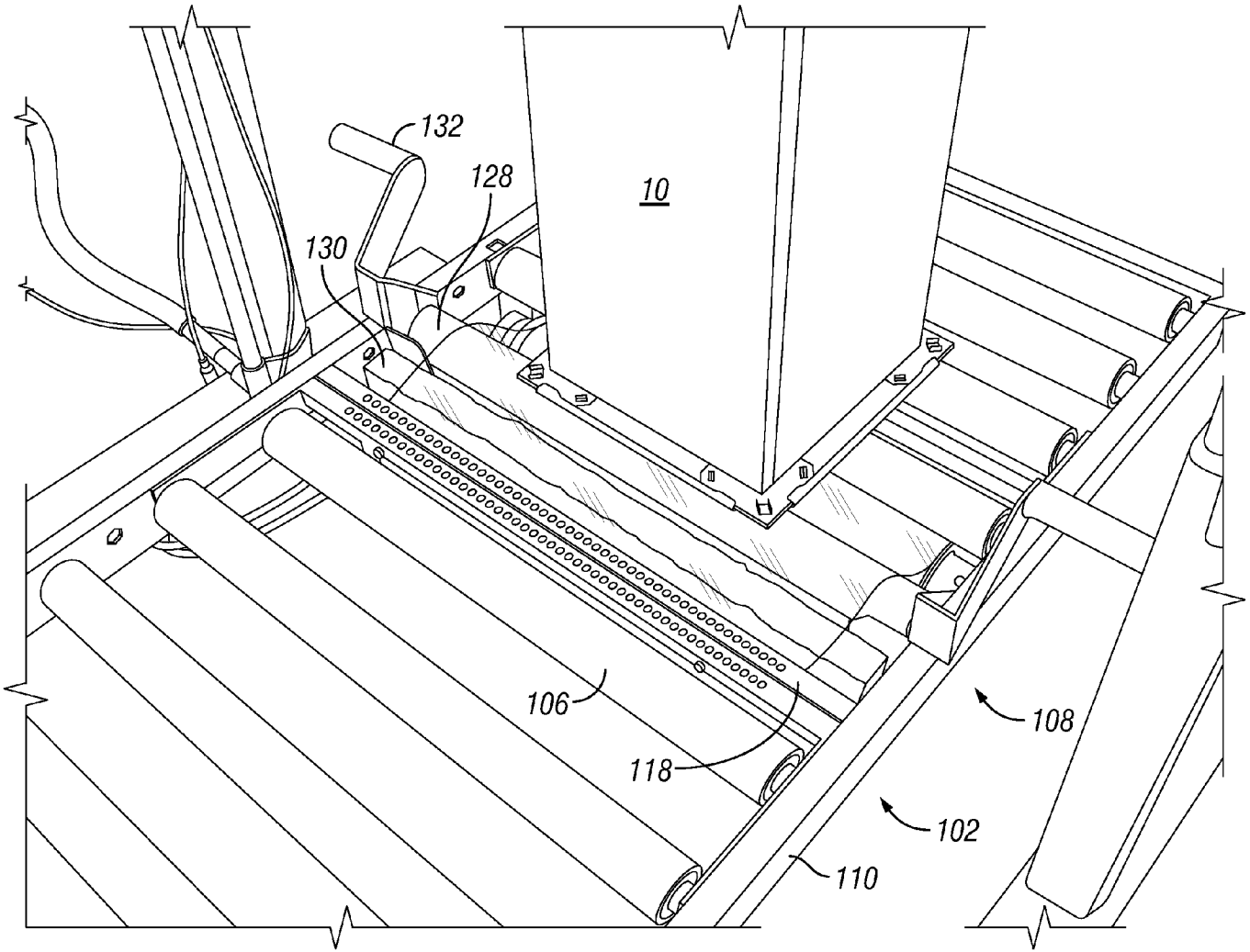
Figure 6:
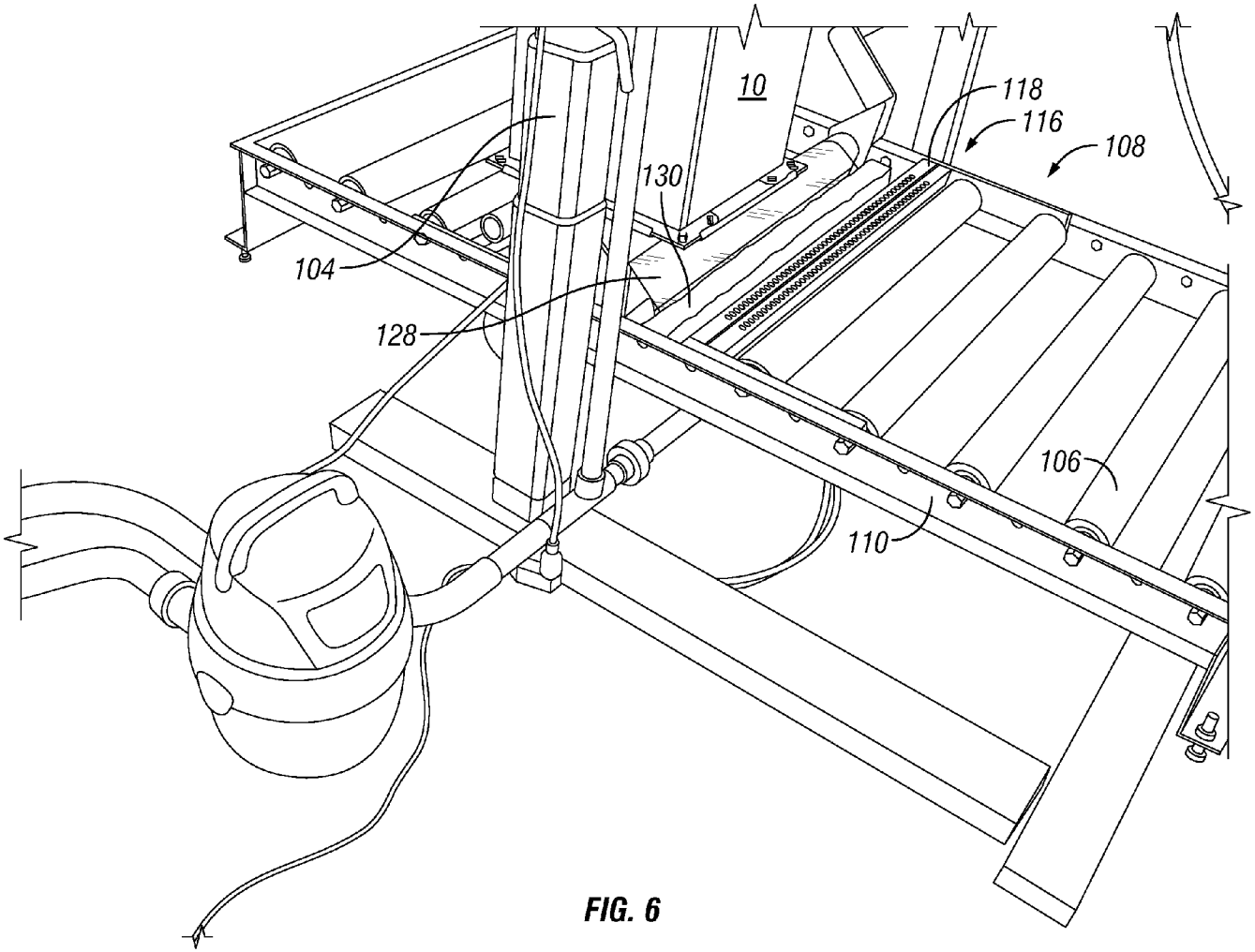

FIGS. 4 through 6 specifically show the pivot assembly 114, which is disposed at the exit side of the hinged sub-frame 112. The pivot assembly includes the normally-upwards rubber covered roller 128 to which the duct wrap lightly adheres. The pivot assembly also includes a normally-recessed applicator 130 at the exit side of the rubber roller. As shown in FIGS. 4 through 6, the applicator may be formed from a sponge material sufficiently soft to generally conform to an outer surface of the duct section 10, when the applicator is in a deployed position above the conveyor rollers 106. Foamed polymers also could be used for the applicator sponge.

As mentioned, the pivot assembly 114 is movable from a normal or retracted position to a deployed position. In the embodiment shown in FIG. 4, the pivot assembly includes a pedal 132 with which an operator can pivot the assembly to bring the applicator 130 from its normal retracted position to its deployed position above the rollers 106 of the conveyor 102. Alternatively, the pivot assembly can be automatically actuated by the duct section 10 triggering a photo eye, finger switch, or the like.

Figure 7:
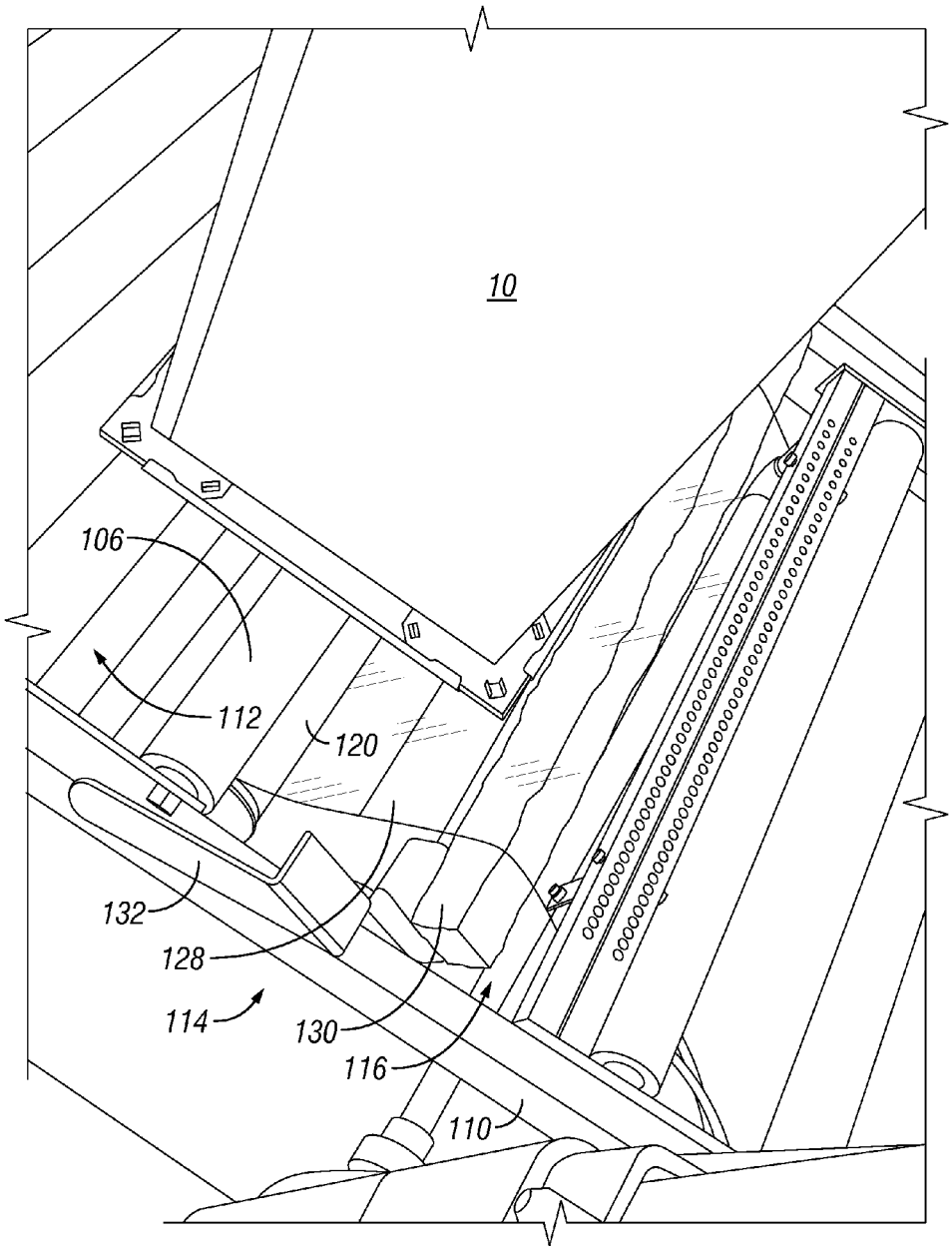
FIGS. 7 through 9 show the lower wrapping tool, with the applicator pivoting to its deployed position for pressing the duct wrap onto the leading surface of the duct section.
Figure 8:
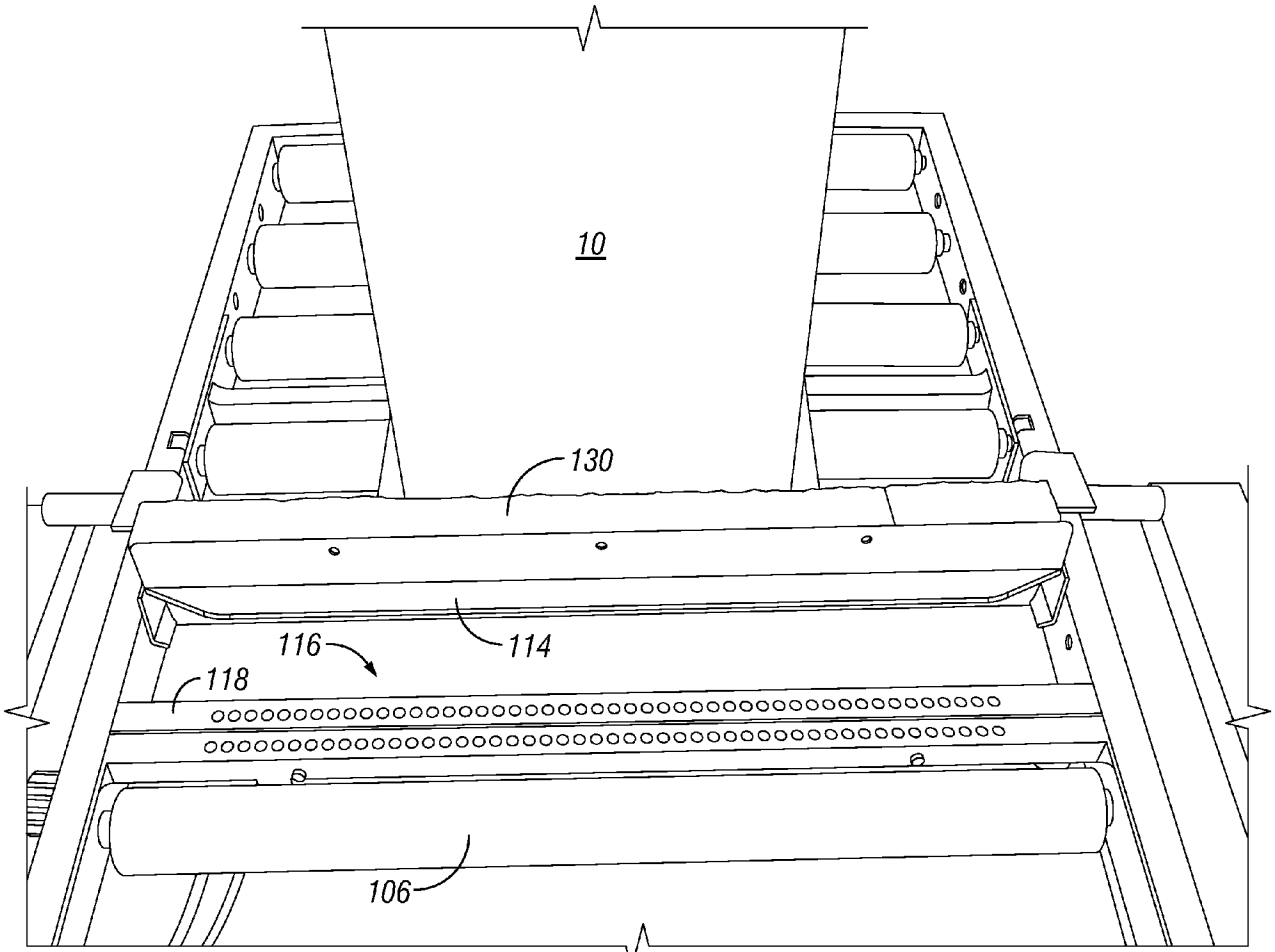
Figure 9:
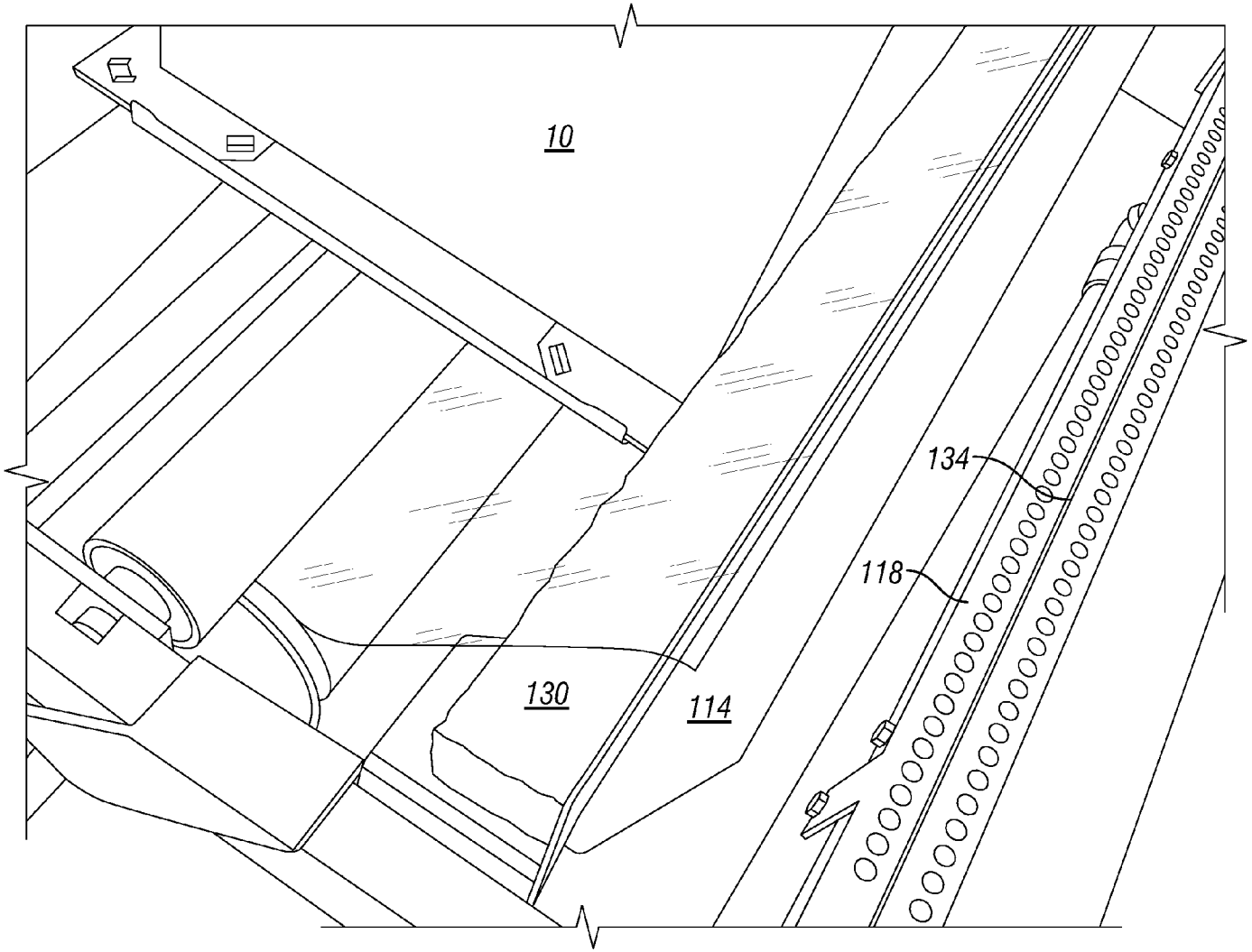

In any case, as shown in FIGS. 7 through 9 the pivot assembly 114 can be pivoted from its normal retracted position where the applicator 130 is recessed below the conveyor rollers 106 to a deployed position where the applicator is exposed above the conveyor 102 to press duct wrap against the leading surface of a duct section 10. In some embodiments, the pivot assembly is biased to its normal retracted position by a spring or the like (not shown).

Figure 10:
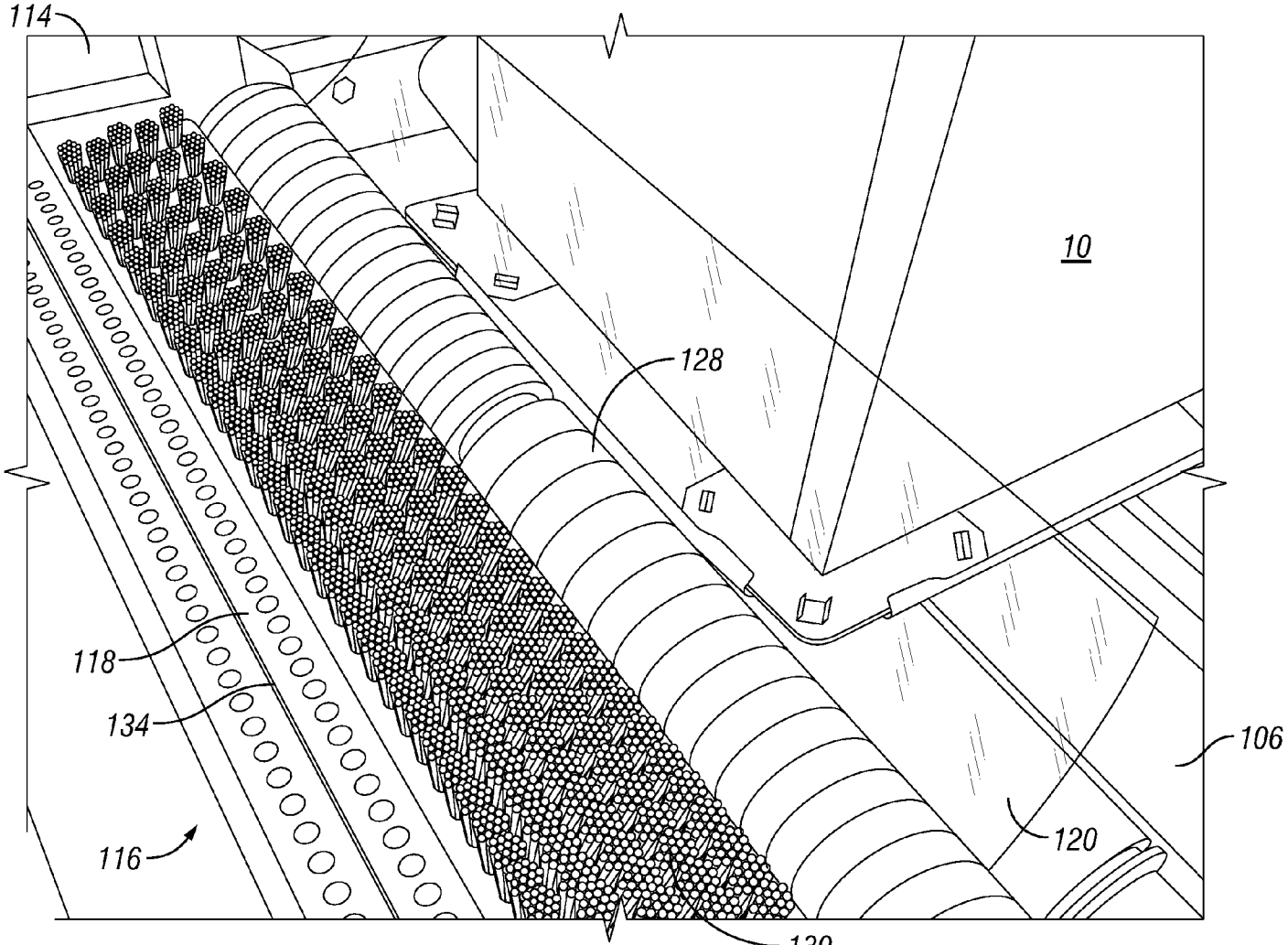
FIGS. 10 through 12 show another embodiment of the lower wrapping tool including a broom applicator in place of a sponge.
Figure 11:
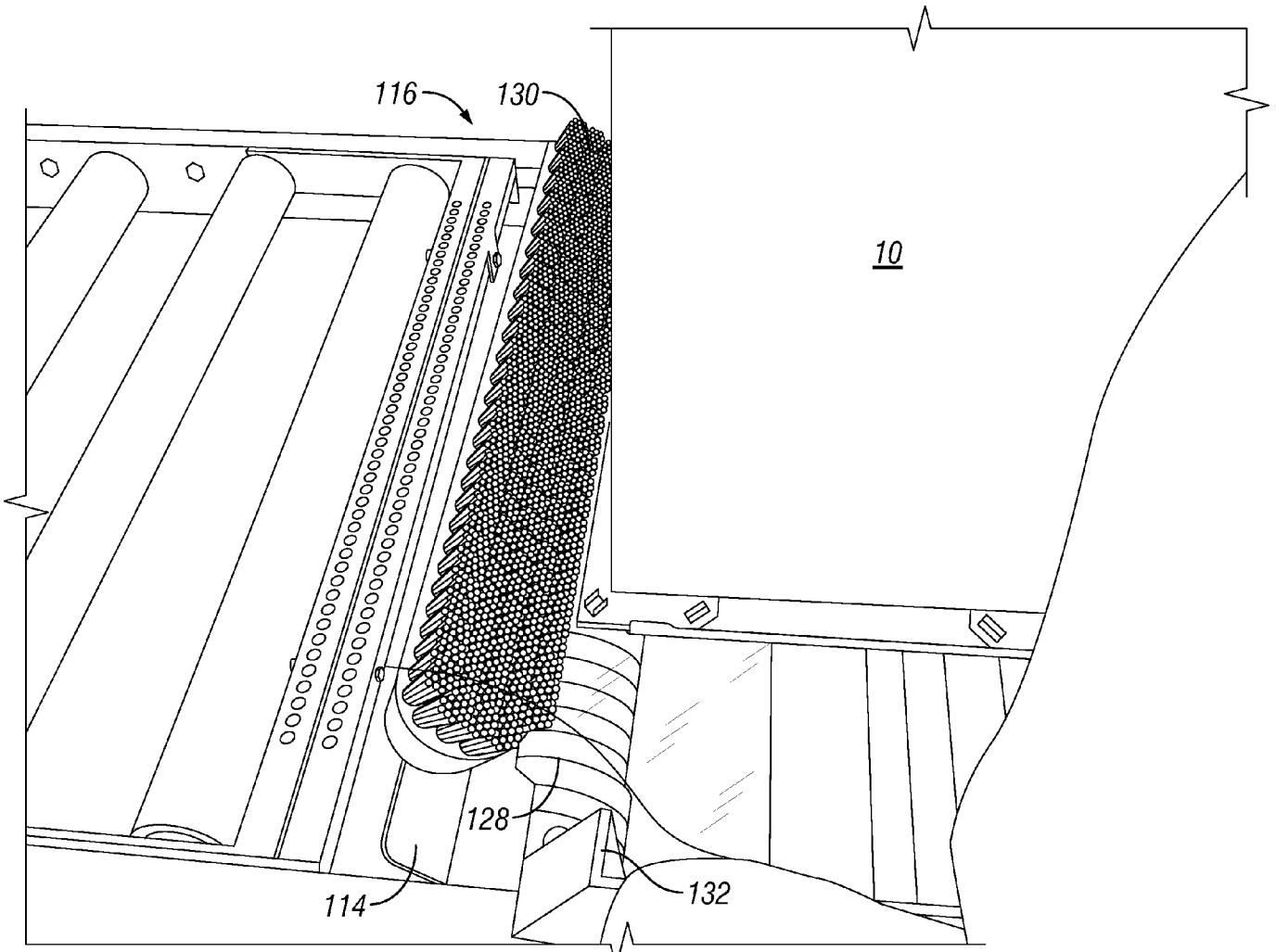
Figure 12:
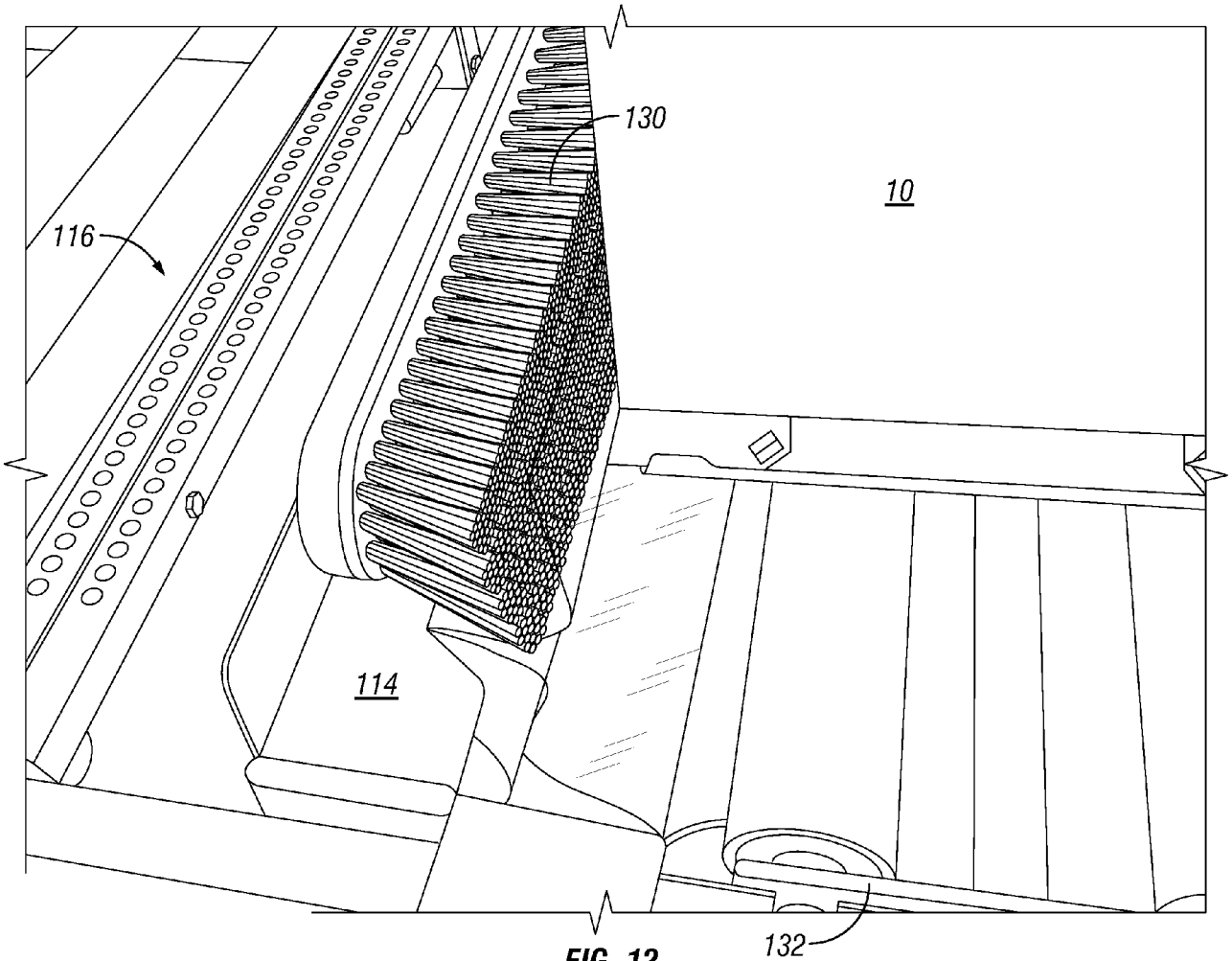

FIGS. 10 through 12 show another embodiment of the pivot assembly 114, in which a soft brush is used for the applicator 130.

Figure 13:
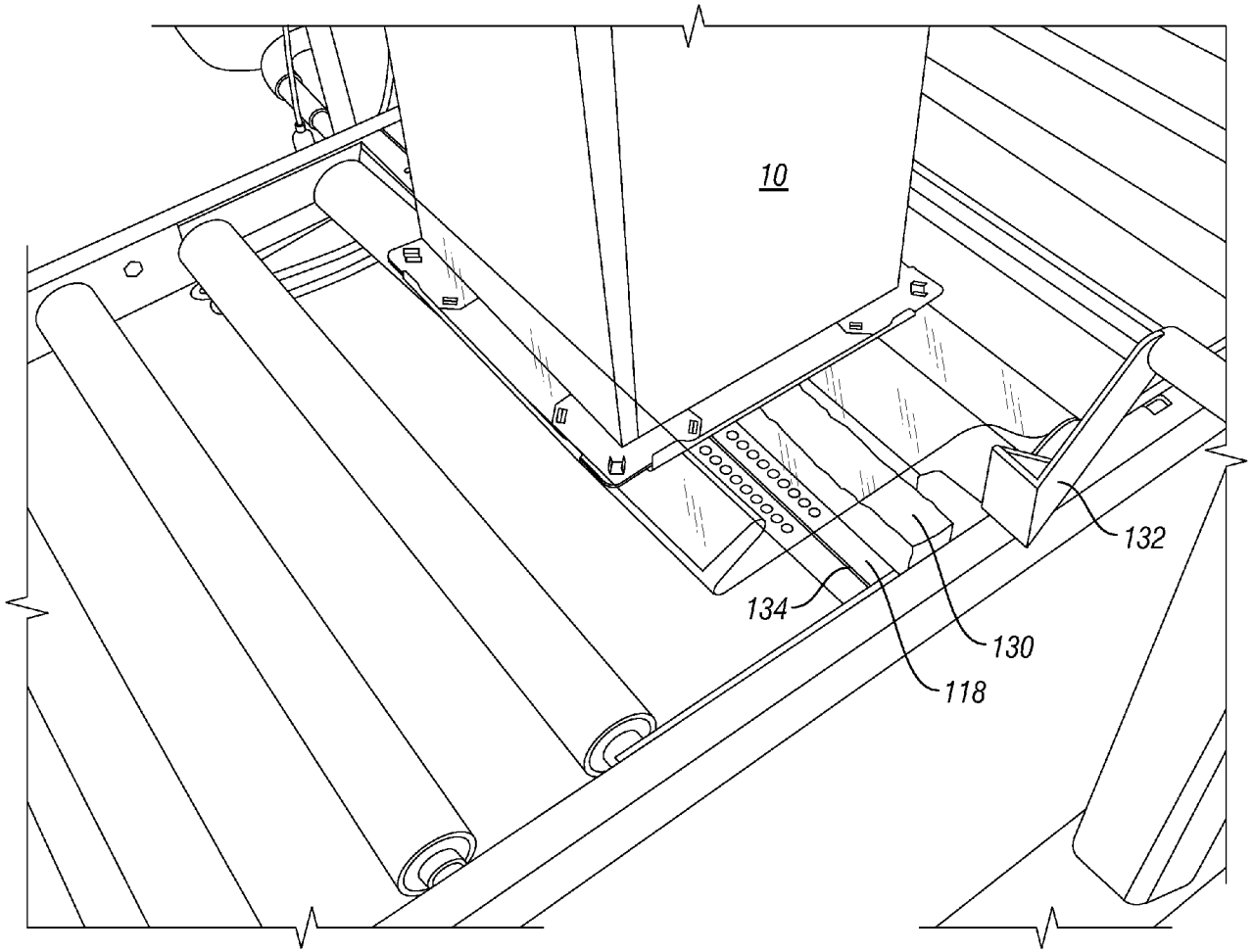
FIGS. 13 through 15 show the duct section exiting the lower wrapping tool across a slicing apparatus that includes vacuum tubes and a cut-off knife housed between the vacuum tubes.

Referring to FIG. 13, after passing over the pivot assembly 114, the duct section 10 carries the duct wrap across the slicing apparatus 116 disposed at the exit end of the lower wrapping tool 108. The slicing apparatus includes at least two vacuum tubes 118 as discussed above. Each of the vacuum tubes includes a plurality of upward-opening holes through which vacuum can be applied to slidingly hold the duct wrap film against the tubes. The slicing apparatus also includes a thin and wavy knife blade 134 that is disposed between and extends along the first and second vacuum tubes. The knife blade is retractably operable, for example by a pneumatic cylinder 136, to quickly slice through duct wrap held by the vacuum tubes. At least during the slicing operation, the vacuum tubes hold down the duct wrap so that the knife blade can slice diagonally upward through the duct wrap.

During operation of the disclosed embodiment, the vacuum tubes 118 provide continuous suction on the duct wrap, via arrays of vacuum nozzles 138 that are spaced apart along the tubes. The suction holds the duct wrap down against the tubes while permitting the duct wrap to slide across the tubes as the duct section 10 exits the lower wrapping tool 108. Beyond the vacuum tubes, the duct section rolls to the exit end of the roller conveyor 100.

The lower cut-off knife 134 is disposed after the first tube in the group of lower vacuum tubes 118. As the trailing surface of the duct section 10 clears the vacuum tubes, the duct wrap extending from the duct section back to the lower duct wrap supply 120 is severed by the cut-off knife disposed between the vacuum tubes. In the disclosed embodiment, the cut-off knife is manually triggered. Alternatively, the pneumatic piston 136 may be automatically triggered by a photo eye, by a finger switch, or the like.

Figure 14:
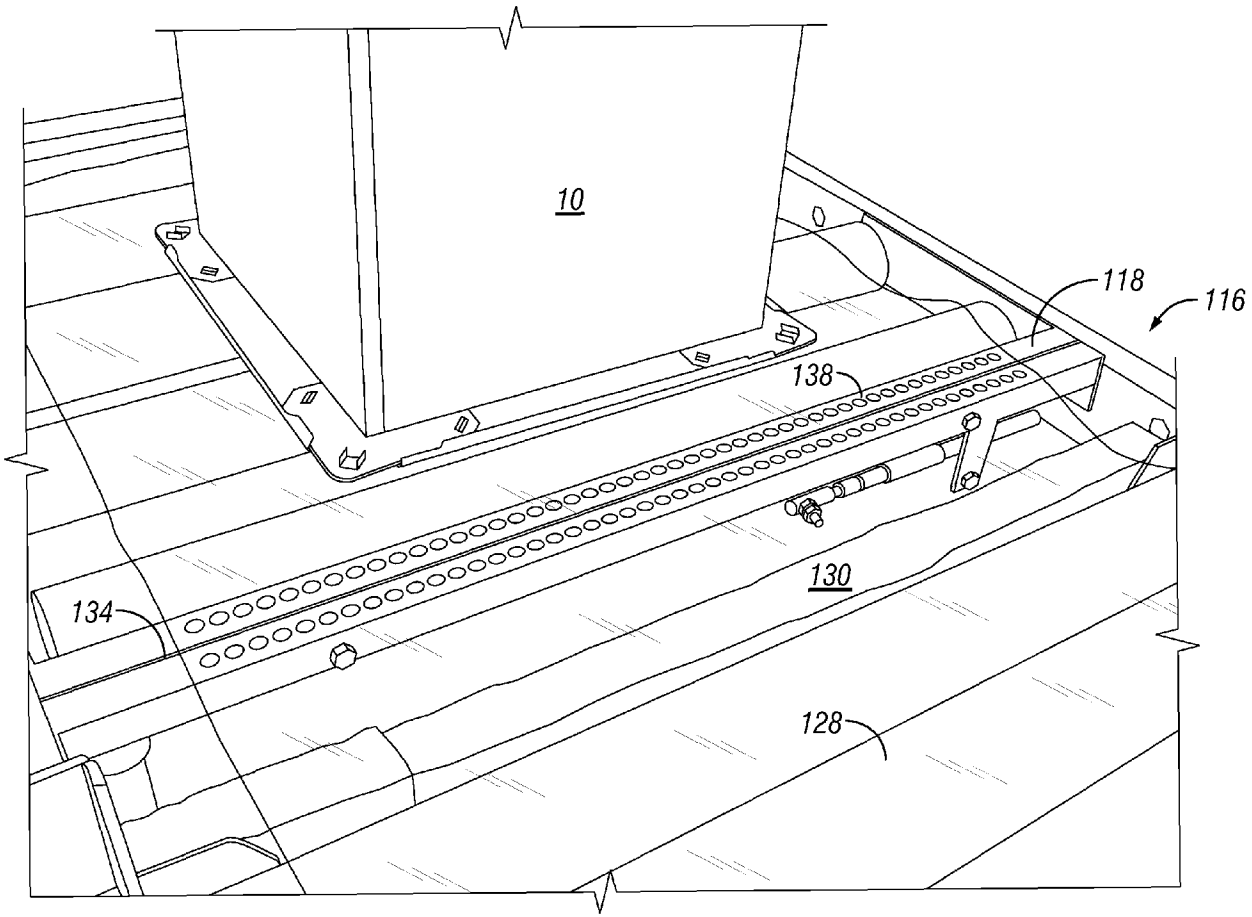
Figure 15:
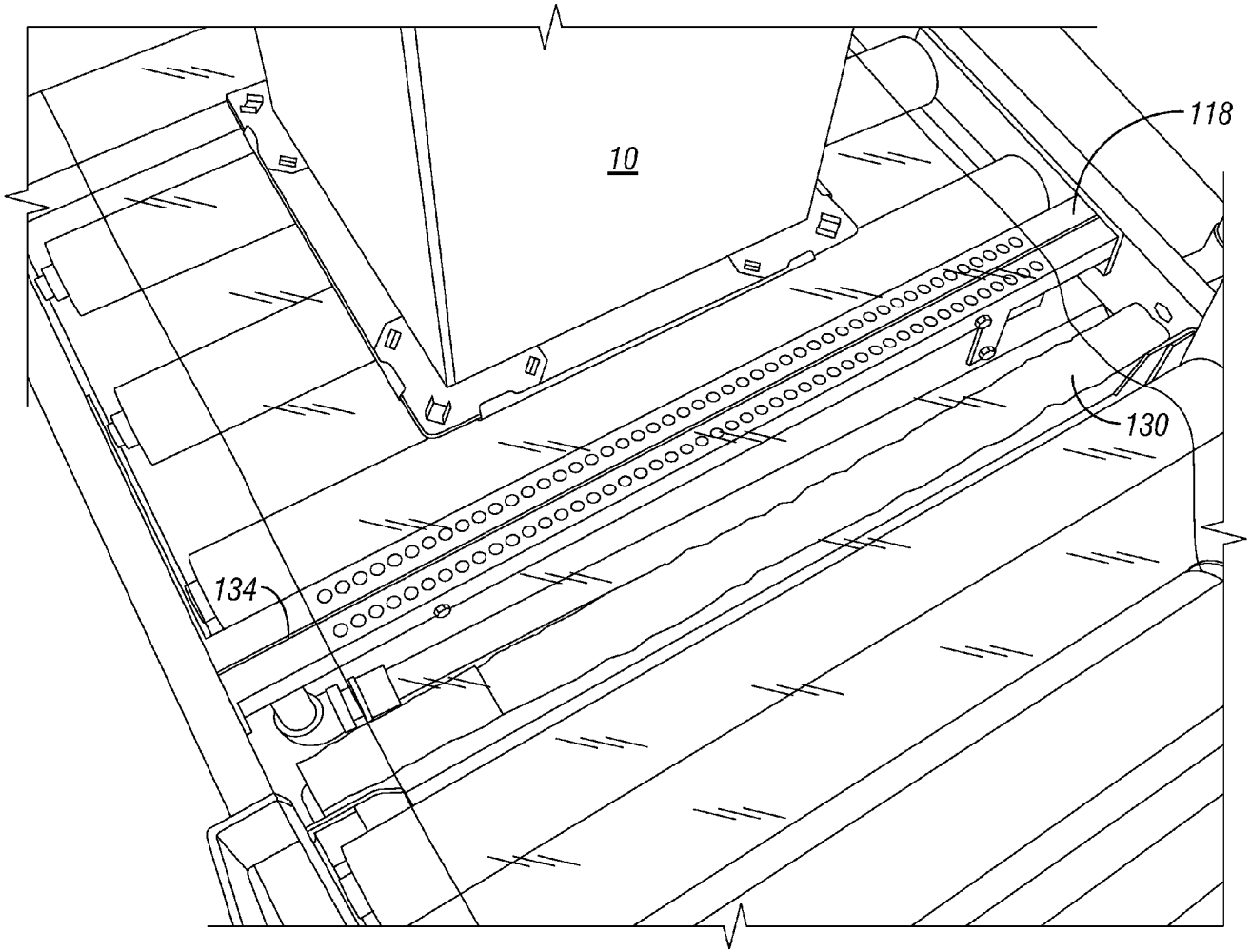
Figure 16:
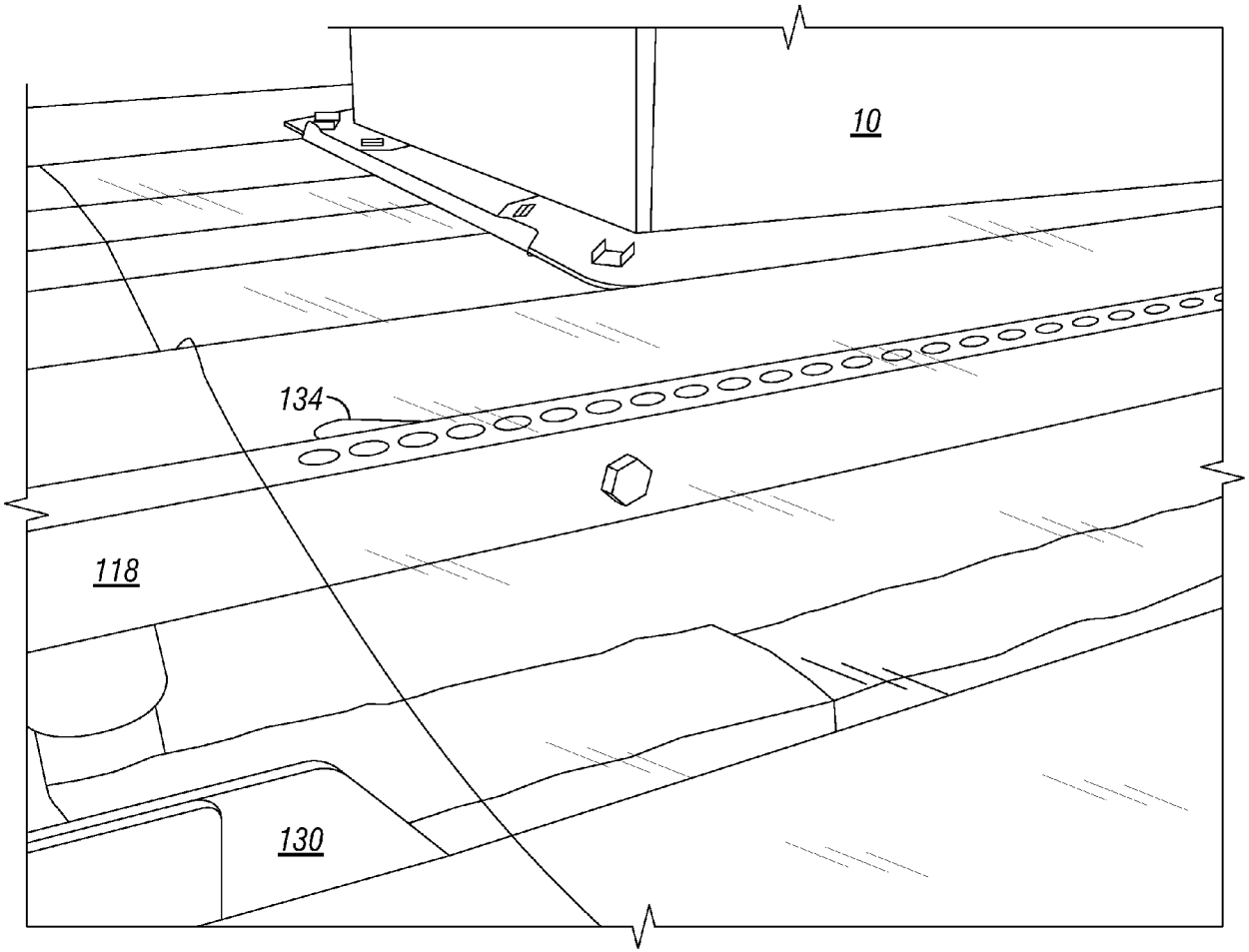
FIG. 16 shows the cut-off knife severing the duct wrap after the trailing surface of the duct section.
Figure 17:
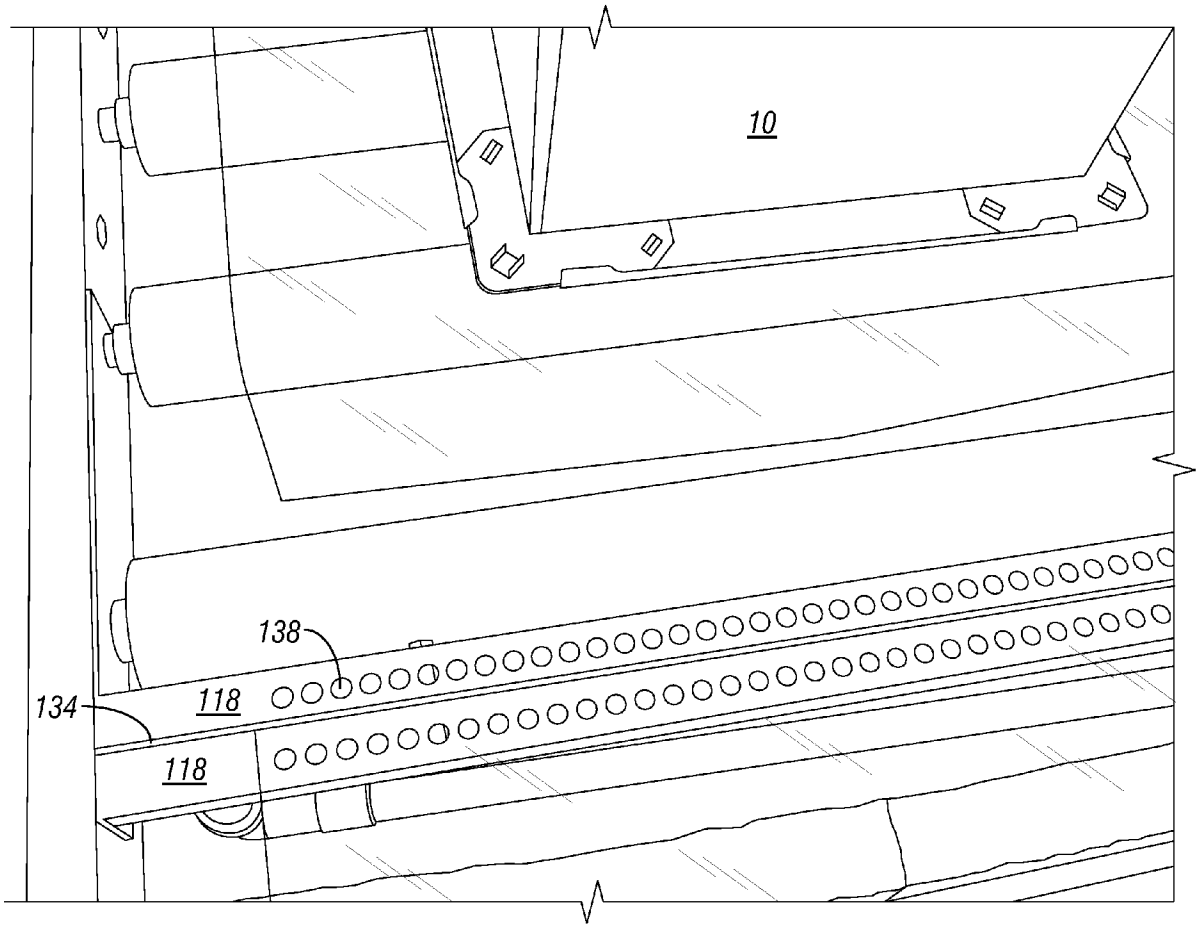
FIG. 17 shows the cut-off knife extended upward between the vacuum tubes.

FIGS. 14 and 15 show the duct section 10 moved across the slicing apparatus 116 with the duct wrap extending from the trailing surface of the duct section, across the slicing apparatus, to the wrap supply 120. In particular, FIG. 15 shows the vacuum tubes 118 sucking down the duct wrap. FIG. 16 shows an upward slicing motion of the knife blade 134 through the duct wrap, which is still held down by the vacuum tubes. FIG. 17 shows the severed duct wrap, with the knife blade still extended above the vacuum tubes.

Figure 18:
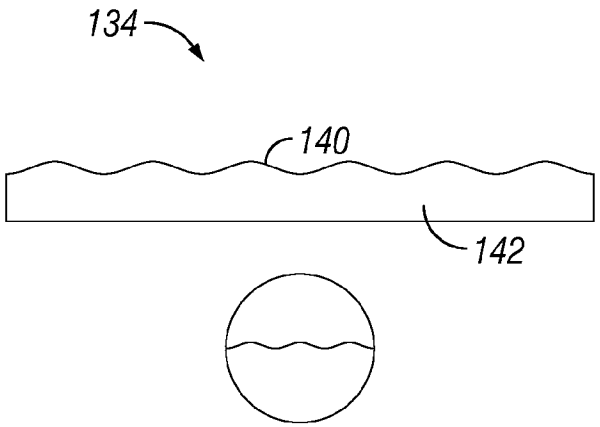
FIG. 18 shows a schematic of a wavy knife blade used in the cut-off knife.

As shown in FIG. 18, the knife blade 134 has a wavy edge 140, and has two diagonal cam slots 142 formed in it. In the disclosed embodiment the blade is driven by a pneumatic cylinder and piston 136. The piston is connected directly to the blade, and the cylinder is hingedly connected to the conveyor frame. The blade is mounted to the frame on pins that slide within the cam slots. Thus, as the piston is extended, the blade slices sideways and upward to sever the duct wrap. As the piston is retracted, the blade retracts sideways and downward, out of the path of the next duct segment.

Figure 19:
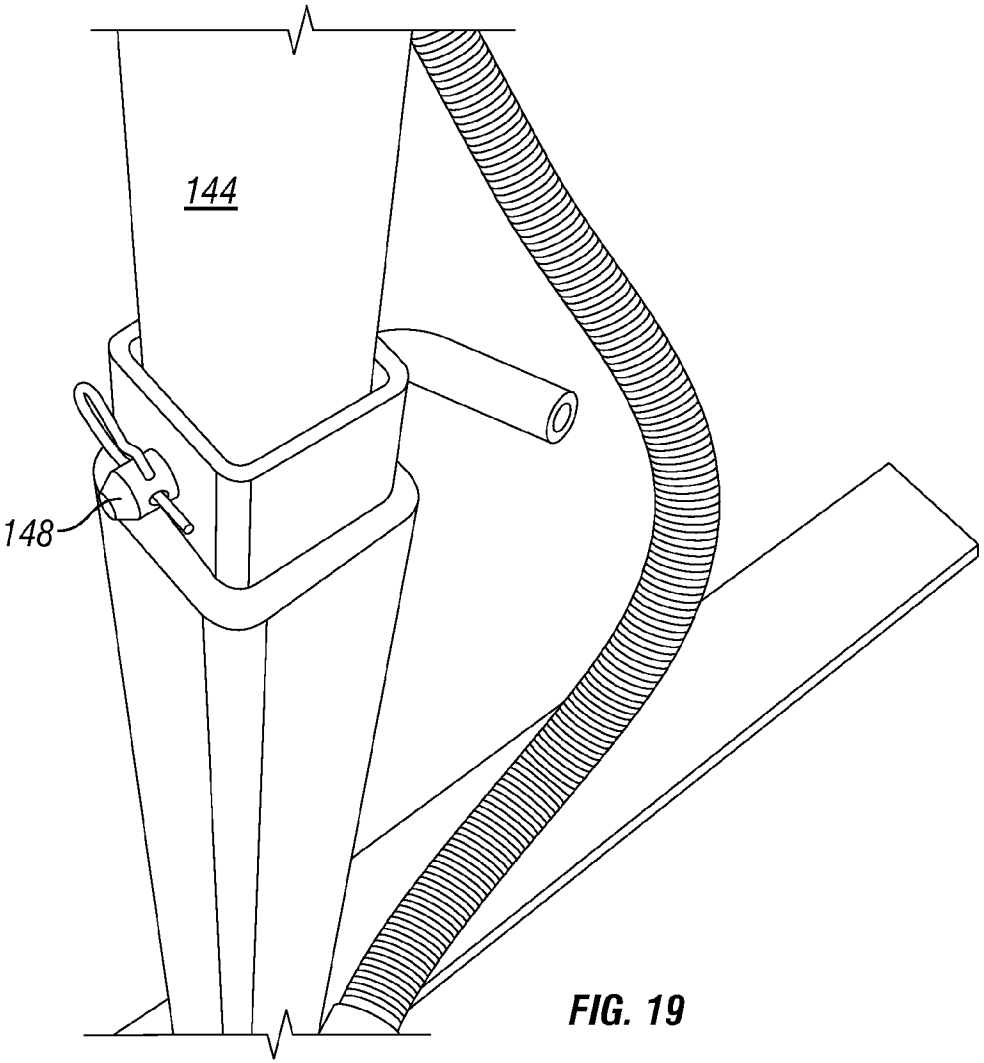
FIG. 19 shows in detail a pull pin for adjusting a height of the standing frame shown in FIG. 1.

Referring back to FIG. 1, the standing frame 102 extends upward from and surrounds the roller conveyor frame. The standing frame includes telescoping legs 144, so that an upper bar or frame head 146 can be positioned to various heights by removing and replacing pull pins 148 from holes in the legs. The frame head height can be selected to match nominal lengths of duct segments, for example, four (4), five (5) or six (6) feet. One of the pull pins is shown in FIG. 19.

Figure 20:
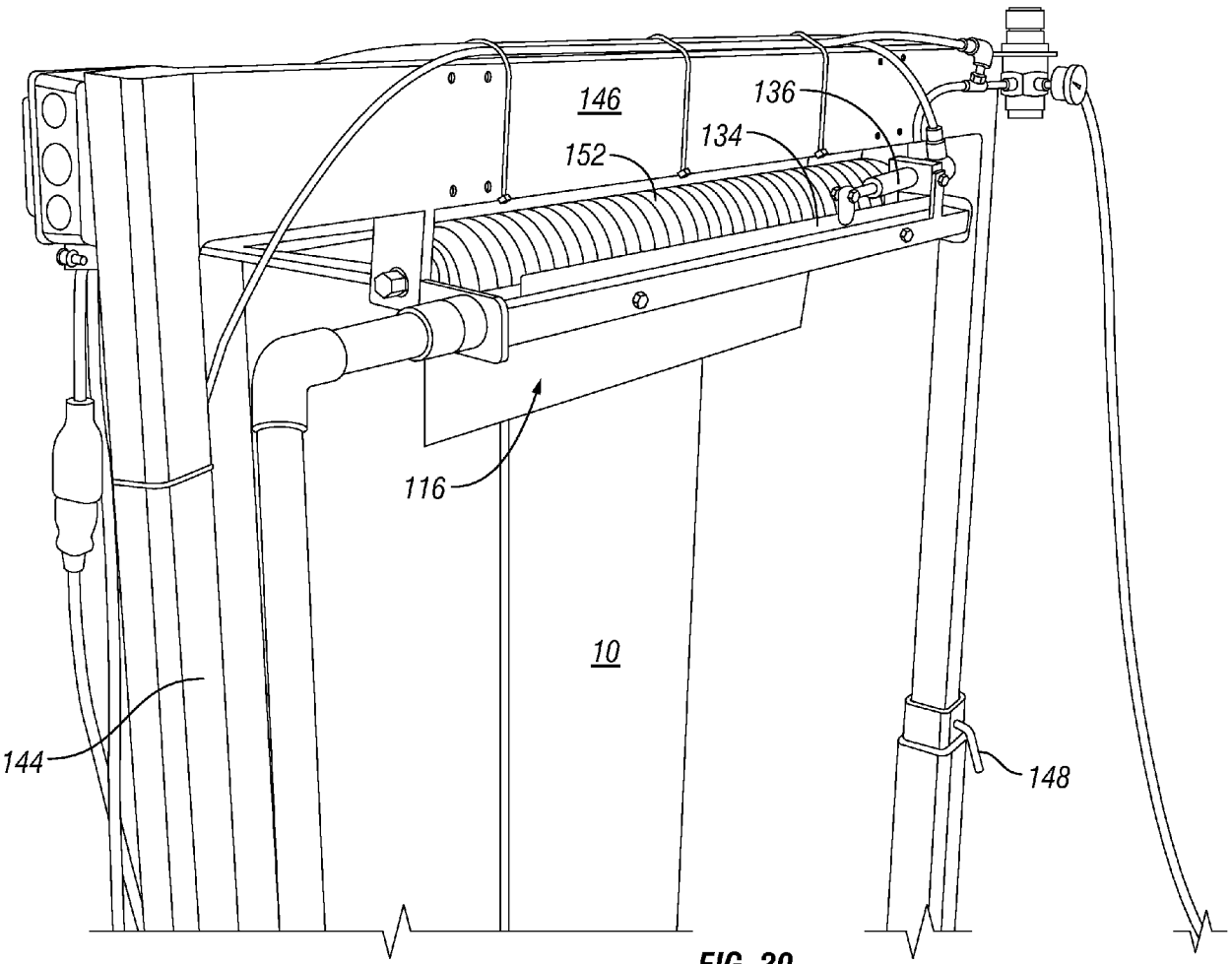
FIG. 20 through 22 show entry and exit views of an upper wrapping tool mounted on the standing frame, including an upper wrap supply, an applicator roller, and an upper slicing apparatus.
Figure 21:
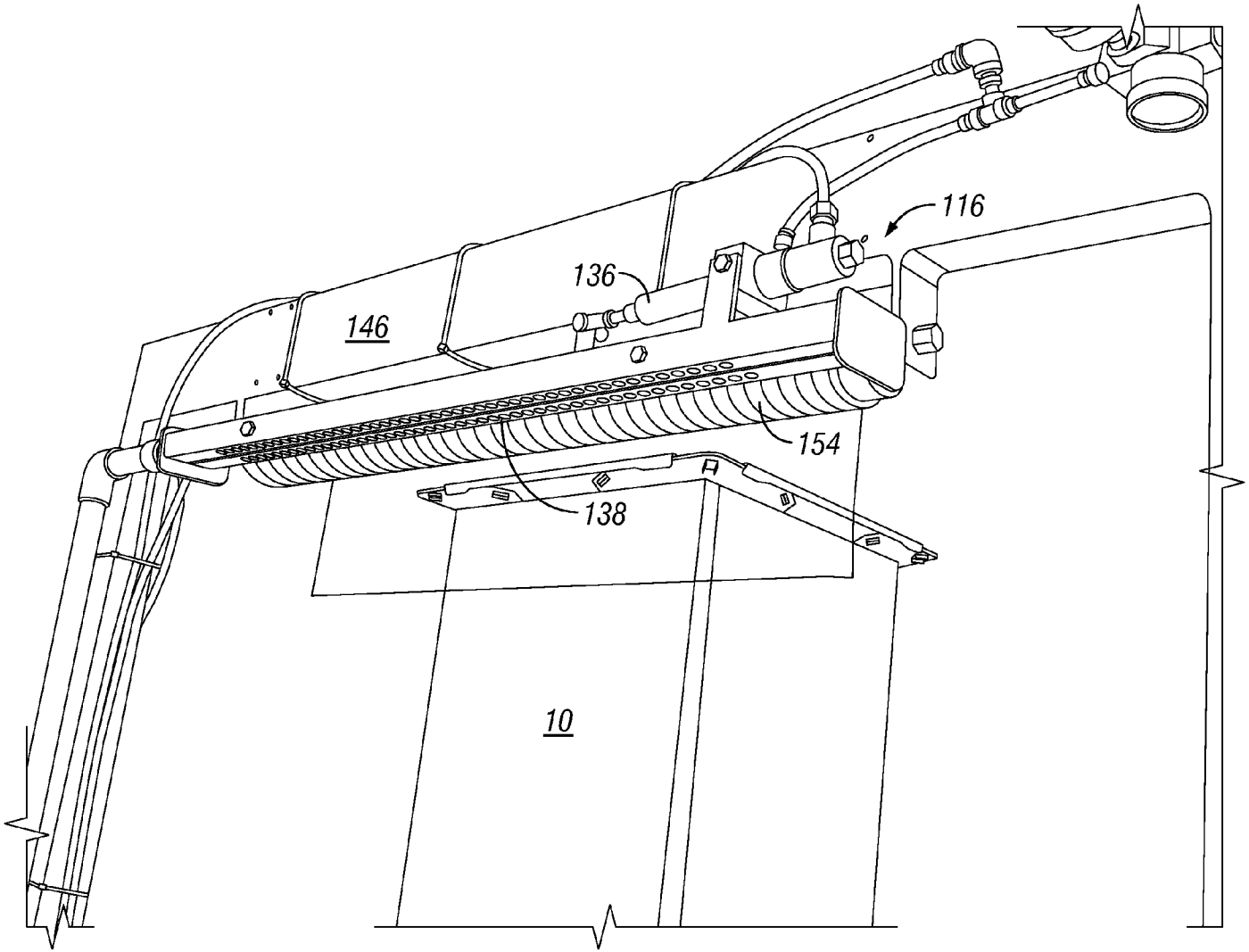

Referring to FIGS. 1 and 20, the frame head 146 supports the upper wrapping tool 150 generally in registry with the lower wrapping tool 108. The upper wrapping tool includes an upper wrap supply 152 generally similar to the lower wrap supply 120, an upper applicator 154, a group of at least two vacuum tubes 118 substantially similar to the lower vacuum tubes, and a slicing apparatus 116 substantially similar to the lower slicing apparatus. FIG. 20 shows in side perspective view the pneumatic cylinder 136, knife 134, and pivotal connections of the upper slicing apparatus as well as the vacuum tubes. FIG. 21 shows the upper slicing apparatus in bottom perspective view to reveal the suction holes 138 of the vacuum tubes, which hold the duct wrap up so that the upper knife can slice through the duct wrap.

Figure 22:
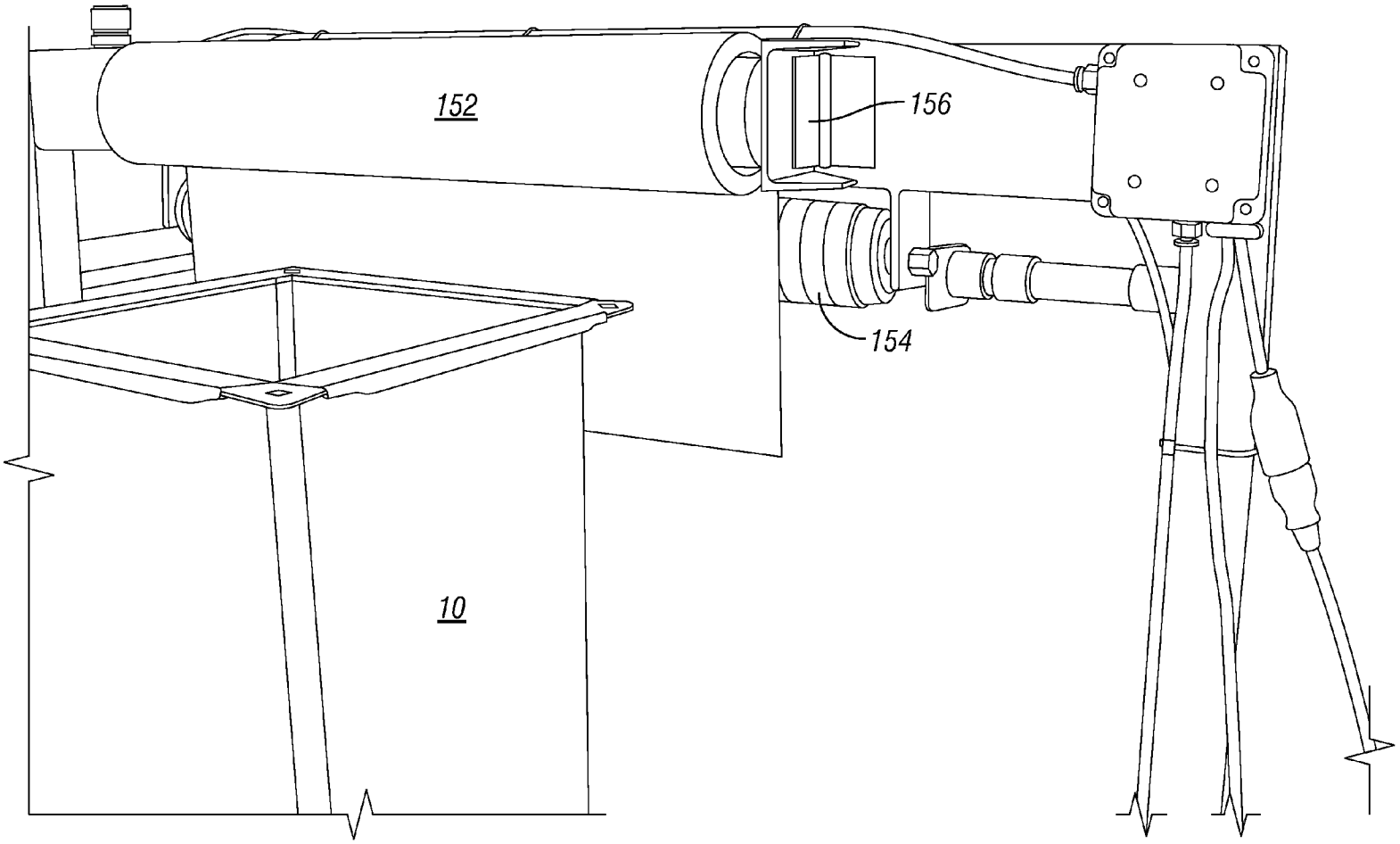
Figure 23:
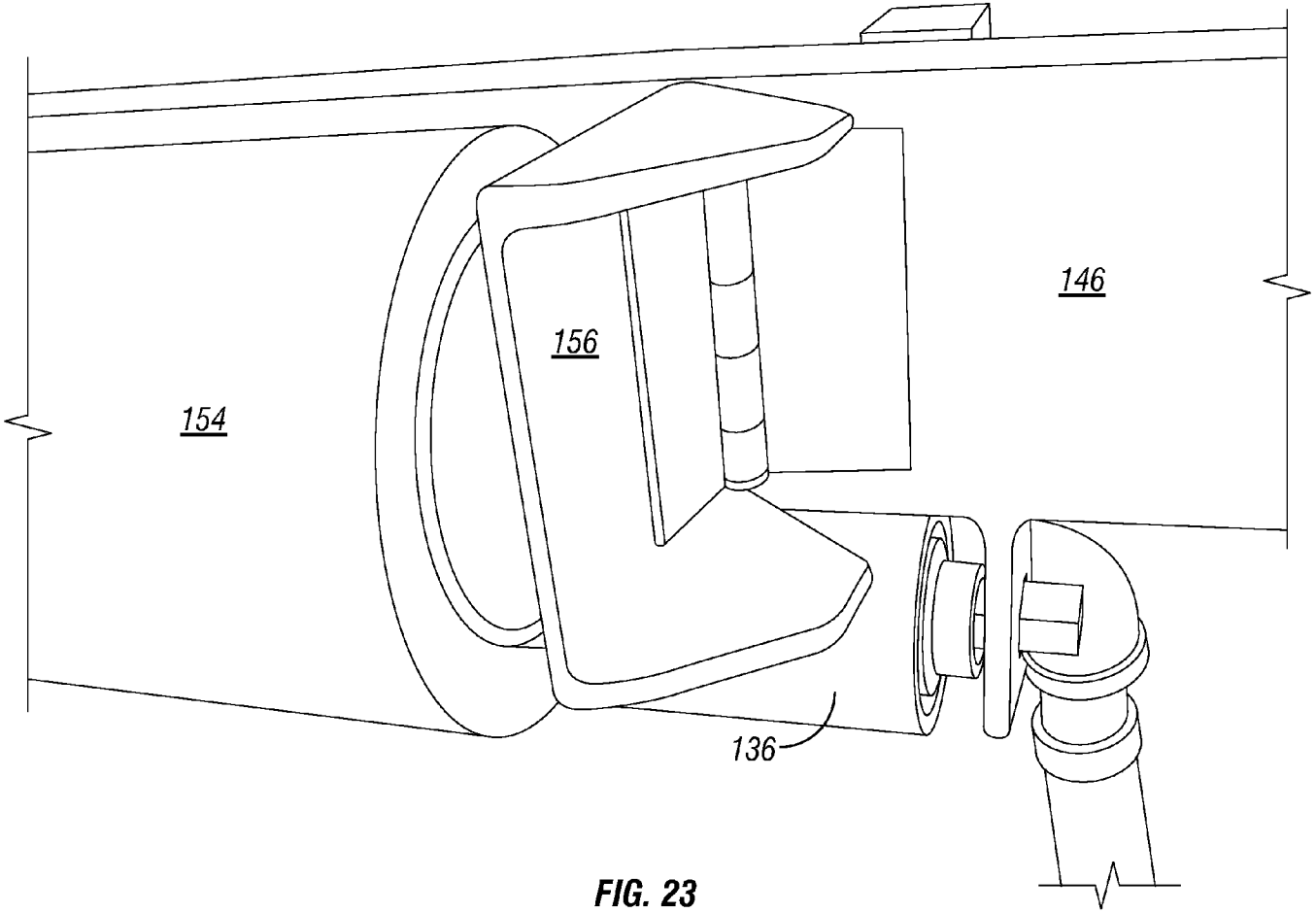
FIG. 23 shows a swing in core support used in the upper wrap supply.

In the disclosed embodiment, the upper wrap supply 152 includes swing-in supports 156 (as shown in FIG. 23) for a roll of duct wrap. When the roll of duct wrap is loaded onto the swing-in supports, the duct wrap hangs downward from the upper wrap supply across the entry side of the upper applicator 154. FIG. 22 shows a correct amount of duct wrap film hanging down ready for a duct section to be pushed under the soft rubber roller that composes the upper applicator. The duct wrap adheres somewhat to the rubber coating on the upper applicator roller. The duct wrap adheres more to the duct segment 10 than to the upper applicator. The roller applies light pressure against the upward open end of the duct section, causing the duct wrap to adhere to the duct section as shown in FIG. 24.

Figure 24:
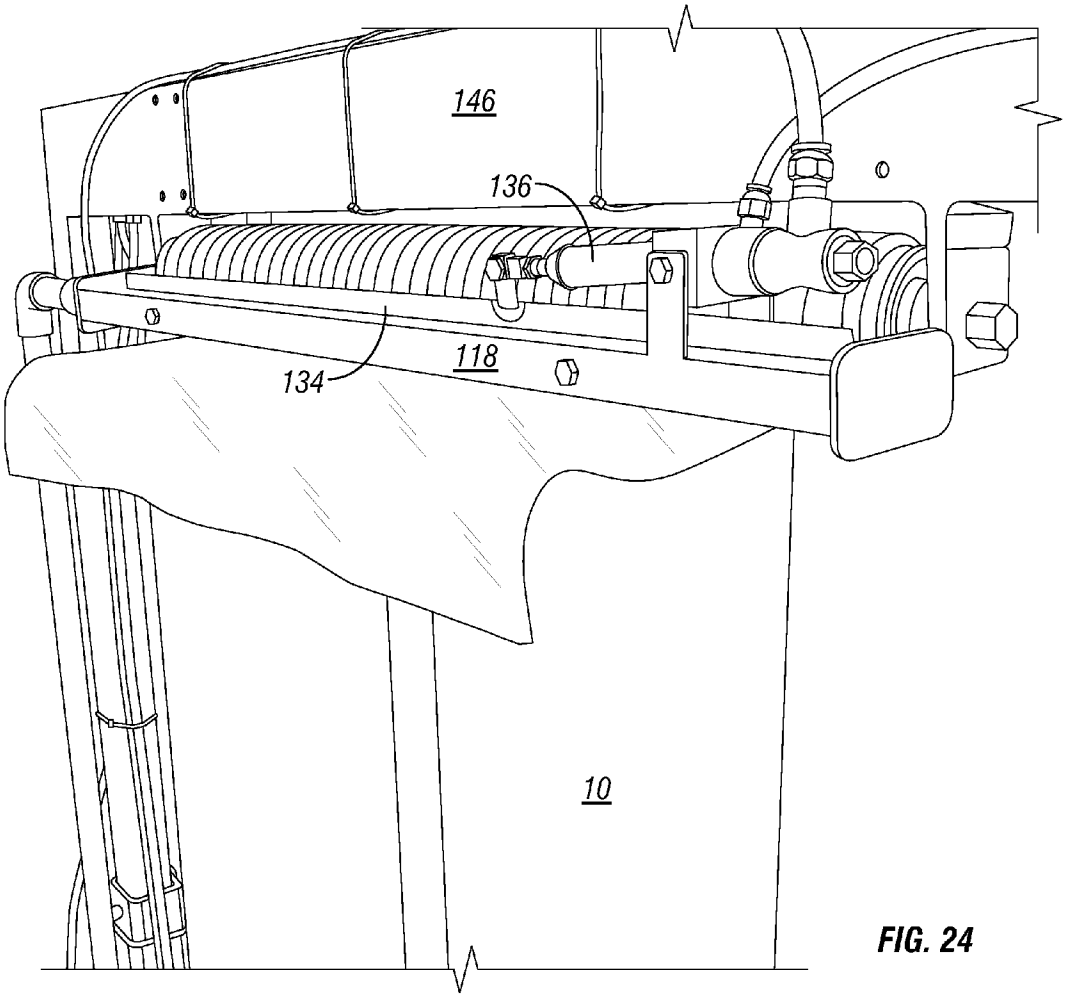
FIG. 24 shows the duct section entering the upper wrapping tool.
Figure 25:
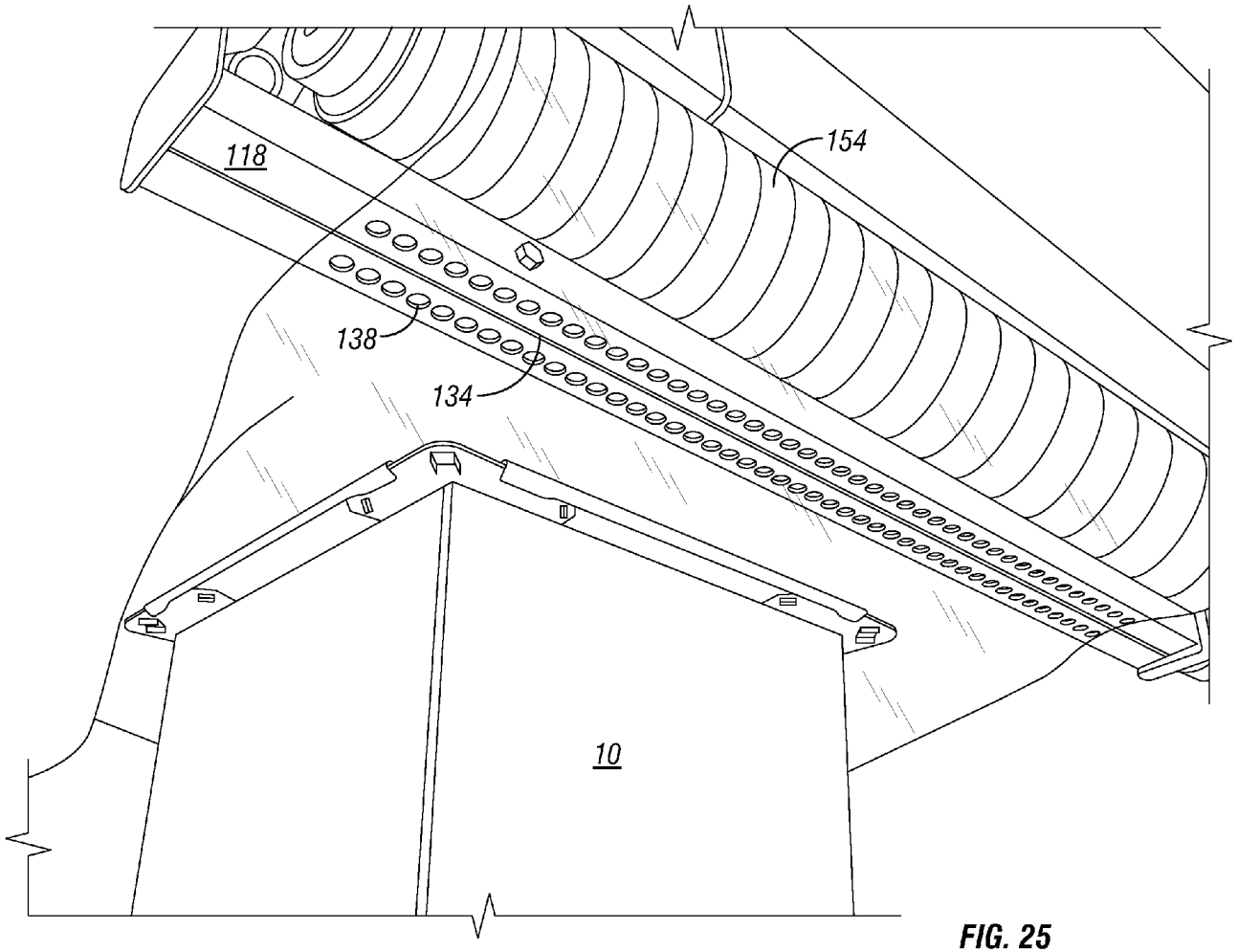
FIG. 25 shows the duct section exiting the upper wrapping tool.
Figure 26:
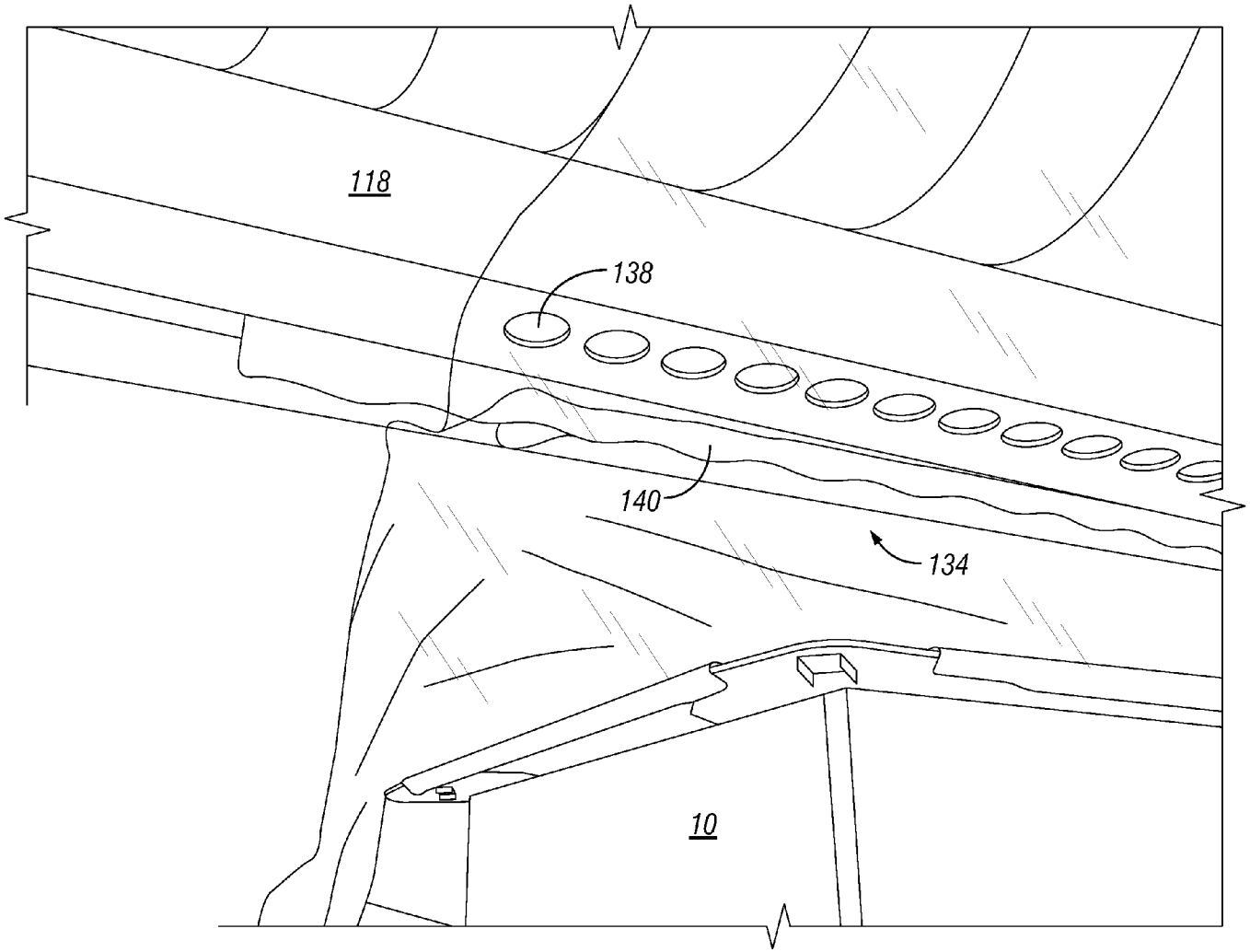
FIG. 26 shows the upper slicing apparatus severing the duct wrap after the trailing surface of the duct section.

FIG. 24 also shows that, after the duct section 10 passes under the upper applicator 154, the duct section drags the duct wrap across the upper slicing apparatus 116. Suction from the vacuum nozzle 138 holds the duct wrap up against the slicing apparatus in a sliding manner, as shown in FIG. 25. Once the trailing surface of the duct section has passed the slicing apparatus, the upper knife pneumatic piston 136 is actuated to drive the knife 134 diagonally downward, severing the duct wrap as shown in FIG. 26. After the duct wrap has been severed, the end still attached to the upper wrap supply 152 drops away from the first upper vacuum tube and once again hangs down between the wrap supply and the upper applicator 154.

Figure 27:
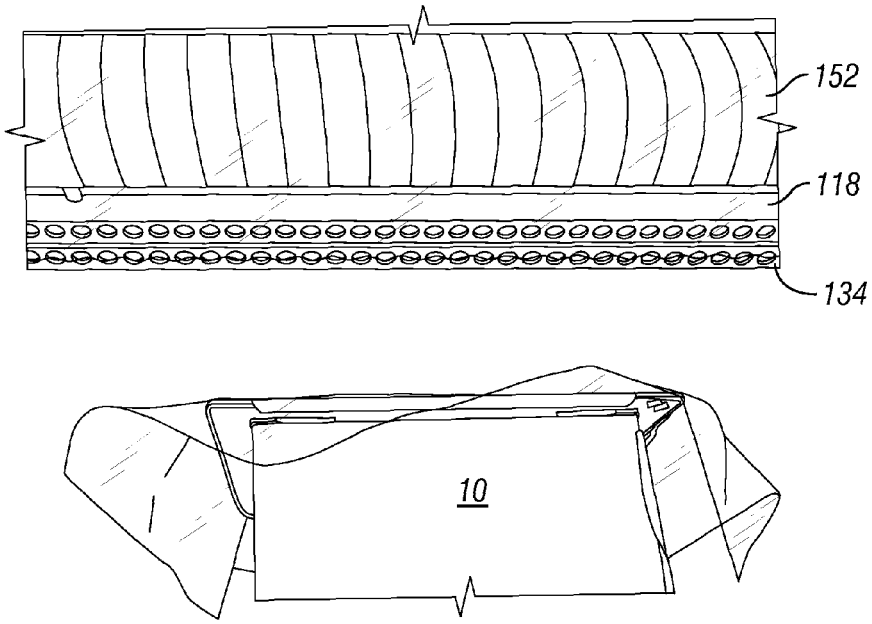
FIGS. 27-29 show further steps in applying duct wrap to the duct section.
Figure 28:
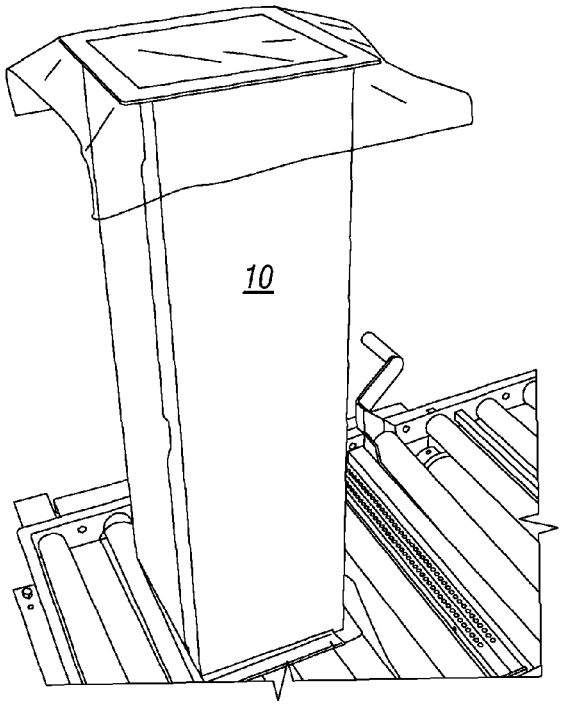
Figure 29:
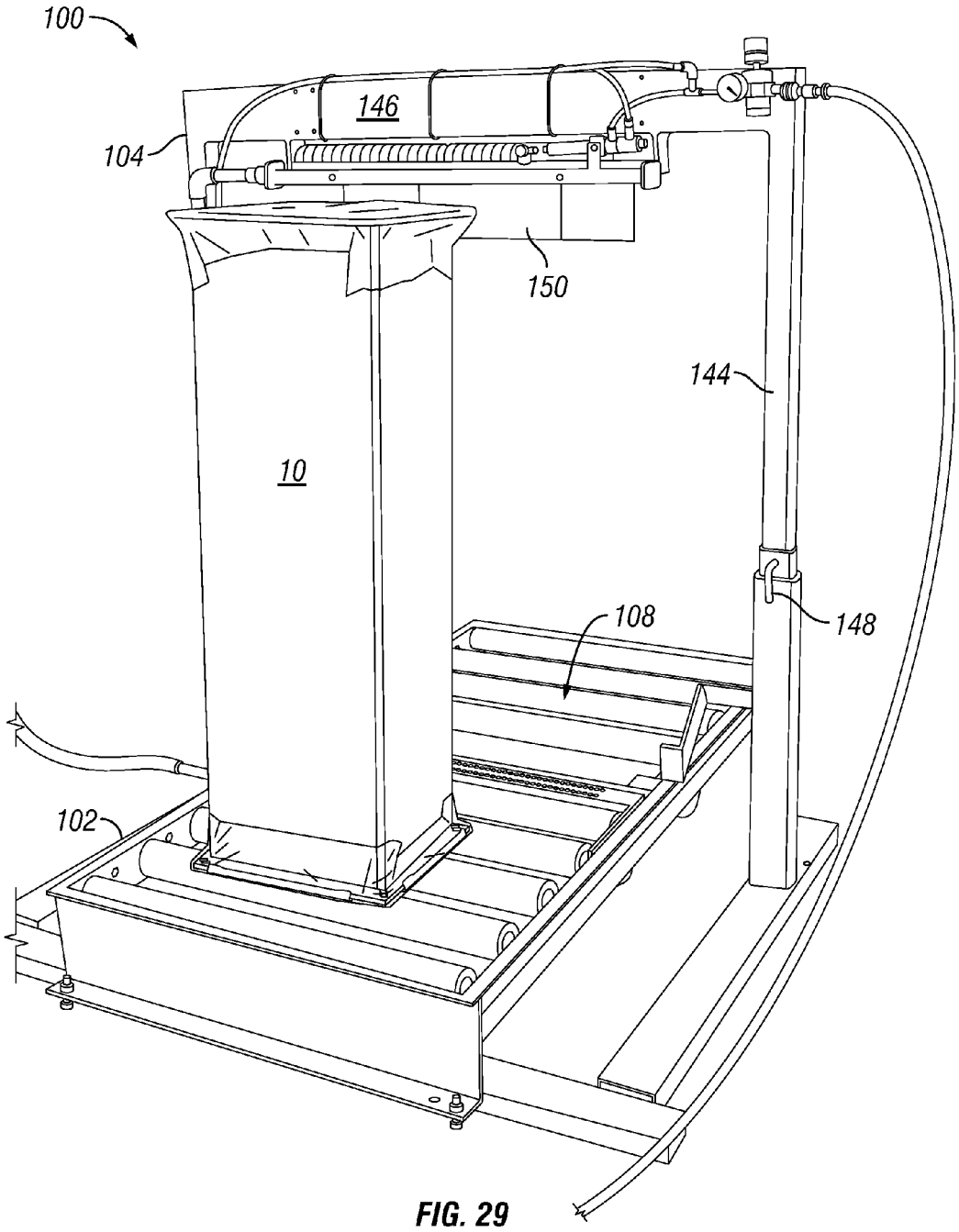

After exiting the slicing apparatus 116, the duct section 10 stands free at the exit end of the roller conveyor. The duct wrap then can be manually applied to surfaces, such as the side surfaces, that were not handled by the duct wrap dispenser. It will be appreciated that further modifications may be made to provide mechanical application of the duct wrap to the side surfaces of duct sections. FIGS. 27 and 28 show steps of applying duct wrap that result in a fully-wrapped duct as shown in FIG. 29.

Although this invention has been shown and described with respect to the detailed embodiments thereof, it will be understood by those skilled in the art that various changes in form and detail thereof may be made without departing from the spirit and the scope of the invention.

For example, as shown and described, the invention is usable to concurrently wrap both ends of a duct section; each wrapping tool also can be used individually. The disclosed embodiment is scaled for 24-inch duct widths, however, the invention may be adapted at least for use with 36 inch or 48 inch duct widths. Also, the duct wrap film may be made in a variety of colors and thicknesses by any of numerous manufacturers, and may be more or less adhesive depending on its composition.

What is claimed is:

1. A finishing apparatus for ductwork, said ductwork defining a duct body having at least one open end, said finishing apparatus comprising:

an operation platform, said operation platform selectively supporting said ductwork;

a first wrapping mechanism integrated with said operation platform, said first wrapping mechanism including a first dispenser for dispensing a first film therefrom;

a first cutting mechanism, said cutting mechanism being integrated with said first wrapping mechanism; and wherein said first wrapping mechanism selectively dispenses said first film adjacent to and against said open end of said ductwork as said ductwork is moved a predetermined distance down said operation platform, said first cutting mechanism selectively cutting said first film after said ductwork has moved said predetermined distance down said operation platform.

2. The finishing apparatus according to claim 1, wherein:

said operation platform includes a plurality of rollers; and said first wrapping mechanism is pivotally disposed adjacent to said rollers so as to be substantially beneath said ductwork when said ductwork is moving down said operation platform.

3. The finishing apparatus according to claim 1, wherein:

said first wrapping mechanism includes a first vacuum assembly, said first vacuum assembly being selectively operable to cause a vacuum to be applied to said first film.

4. The finishing apparatus according to claim 1, wherein:

said first wrapping mechanism includes a first cutting knife, said first cutting knife being selectively moved between a first position where said first film cannot be cut, and a second position where said first film can be cut.

5. The finishing apparatus according to claim 4, wherein:

said first cutting knife defines a wavy blade edge.

6. The finishing apparatus according to claim 1, further comprising:

a frame assembly disposed above said operation platform, said frame assembly supporting a second wrapping mechanism and a second dispenser for dispensing a second film therefrom; and wherein said second wrapping mechanism further includes a second cutting mechanism for selectively cutting said second film.

7. The finishing apparatus according to claim 6, wherein:

said second wrapping mechanism includes a second vacuum assembly, said second vacuum assembly being selectively operable to cause a vacuum to be applied to said second film.

8. A method of sealing a duct body having at least one open end, said method comprising the steps of:

positioning said duct body on an operation platform;

integrating a first wrapping mechanism with said operation platform, said first wrapping mechanism including a first dispenser for dispensing a first film therefrom;

arranging a first cutting mechanism adjacent said first wrapping mechanism;

moving said duct body to a predetermined position on said operation platform, said first wrapping mechanism selectively dispensing said first film adjacent to and against said open end of said duct body; and engaging said first cutting mechanism to cut said first film after said duct body has moved to said predetermined position.

9. The method of sealing a duct body according to claim 8, said method further comprising the steps of:

forming said operation platform from a plurality of rollers; and pivotally disposing said first wrapping mechanism adjacent to said rollers so as to be substantially beneath said ductwork when said ductwork is moving down said operation platform.

10. The method of sealing a duct body according to claim 8, said method further comprising the steps of:

arranging a first vacuum assembly adjacent to said first wrapping mechanism, said first vacuum assembly being selectively operable to cause a vacuum to be applied to said first film.

11. The method of sealing a duct body according to claim 8, said method further comprising the steps of:

integrating a first cutting knife with said first wrapping mechanism, said first cutting knife being movable between a first position where said first film cannot be cut, and a second position where said first film can be cut.

12. The method of sealing a duct body according to claim 11, said method further comprising the steps of:

forming said first cutting knife to have a wavy blade edge.

13. The method of sealing a duct body according to claim 8, said method further comprising the steps of:

disposing a frame assembly over said operation platform, said frame assembly supporting a second wrapping mechanism and a second dispenser for selectively dispensing a second film therefrom; and integrating a second cutting knife with said second wrapping mechanism.

14. The method of sealing a duct body according to claim 8, said method further comprising the steps of:

integrating a second vacuum assembly with said second wrapping assembly, said second vacuum assembly being selectively operable to cause a vacuum to be applied to said second film.

* * * * *